US005451847A

United States Patent [19]

Nakanishi

[11] Patent Number: 5,451,847

[45] Date of Patent: Sep. 19, 1995

[54] VARIABLE ENERGY RADIO FREQUENCY QUADRUPOLE LINAC

[75] Inventor: Tetsuya Nakanishi, Hyogo, Japan

[73] Assignee: Mitsubishi Denki Kabushiki Kaisha, Tokyo, Japan

[21] Appl. No.: 193,424

[22] Filed: Feb. 8, 1994

[30] Foreign Application Priority Data

Jan. 20, 1994 [JP] Japan ..... 6-004875

[51] Int. Cl.[6] ..... H01J 23/00

[52] U.S. Cl. ..... 315/505; 315/506; 315/507; 315/5.42; 331/3

[58] Field of Search ..... 328/228, 233, 234–238; 315/5.41–5.43, 505, 506, 507, 501; 250/390 R; 331/3, 94.1

[56] References Cited

U.S. PATENT DOCUMENTS 4,992,744 2/1991 Fujita et al. ..... 328/233
5,334,943 8/1994 Sawada ..... 328/233

FOREIGN PATENT DOCUMENTS

3919210A1 12/1990 Germany ..... H05H 9/00

OTHER PUBLICATIONS

A. Schempp, "RFQ Accelerators For Ion Implantation," Nuclear Instruments and Methods in Physics Research B50 (1990) pp. 460–464, North-Holland.

N. Tokuda, S. Arai, A. Imanishi, T. Morimoto and E. Tojyo, "Progress Report On The INS 25.5-MHZ Split Coaxial RFQ," Particle Accelerators, 1992, Vols. 37–38, pp. 75–80.

Donald A. Swenson, "Extensions To The RFQ Domain," Particle Accelerators, 1990, vol. 32, pp. 21–26.

R. W. Thomae, "Recent Developments In Ion Implantation Accelerators," Nuclear Instruments and Methods in Physics Research B50 (1990) pp. 444–454, North-Holland.

Proceedings of the 7th Symposium on Accelerator Science and Technology, Dec. 1989, Osaka, Japan.

*Primary Examiner*—Sandra L. O'Shea
*Assistant Examiner*—Ashok Patel
*Attorney, Agent, or Firm*—Wolf, Greenfield & Sacks

[57] ABSTRACT

A variable energy radio frequency quadrupole linac for emitting focused and accelerated beams by changing radio frequency energy levels, wherein the accelerating cavity is divided by a plane perpendicular to the beam direction and in a radio frequency sense, and the radio frequency power level in the downstream accelerating cavity is made to be lower than that in the upstream accelerating cavity, one of the divided cavities being self oscillated, and the other being separately oscillated, a separating plate being provided between separated electrodes, the radio frequency phases in the upstream cavity and the downstream cavity being relatively changeable, and a thin plate region being provided in the periphery of a beam passing window on the separating plate, thereby the power in the cavity can be lowered without expanding the energy spread of the emitted beams so much.

41 Claims, 23 Drawing Sheets

VARIABLE ENERGY RADIO FREQUENCY QUADRUPOLE LINAC

BACKGROUND OF THE INVENTION

1. Field of the Invention

The present invention relates to a radio frequency quadrupole linac (hereinafter referred to as an RFQ linac) of a variable energy type, for efficiently accelerating low-energy charged beams, which is utilized, for example, as an ion implantation apparatus and so forth.

2. Description of the Related Art

FIG. 1A is a partially cut perspective view showing a simplified conventional split coaxial RFQ linac, which was shown in, for example, "Structure and RF Characteristics of the INS 25.5-MHz Split Coaxial RFQ" (collected papers, from page 92 to page 94), published in the "Proceedings of the 7th Symposium on Accelerator Science and Technology which was held on Dec. 12 to 14, 1989. In the FIG., 1 is a cylindrical cavity, 2 is waving electrodes as electrodes for generating radio frequency quadruple electric field for focusing and accelerating charged particles, and 3 is a back plate for reinforcing the waving electrodes 2. 4 is stems used for shortening each pair of the opposing waving electrodes 2 to the cylindrical cavity 1, and 5 is ports for vacuum exhaust, for inputting a radio frequency, and for mounting a frequency tuner and so forth. The cylindrical cavity 1 attached with the waving electrodes 2 is referred to as an accelerating cavity. These elements are all made of conductor.

FIG. 1B is a perspective view expressing an expanded view of only the waving electrodes 2 shown in FIG. 1A. FIG. 1C is a cross-sectional view in the beam axis direction of the RFQ linac shown in FIG. 1A, and FIG. 1D and FIG. 1E are its A–A′ cross-sectional view indicated by arrows and its B–B′ cross-sectional view indicated by arrows. Note that, in FIG. 1A and FIGS. 1D and 1E, current paths and magnetic field paths are shown together, and the back plate 3 is omitted.

Further, FIGS. 2A and 2B are cross-sectional views showing a reentrant type cavity. In the FIG., 6 is an inner conductor. FIGS. 3A and 3B are cross-sectional views showing a reentrant type cavity in which the shape of the inner conductor 6 is modified, and FIGS. 4A and 4B are cross-sectional views of a 4-electrode cavity similar to the split coaxial cavity shown in FIG. 1C by adding a further pair of the inner conductors shown in FIGS. 3A and 3B.

FIG. 5 to FIG. 8 are perspective views or cross-sectional views showing an electrode part or an accelerating cavity of different type RFQ linac. FIG. 5 is the perspective view showing an outline of angular type electrodes. In the FIG., 7 is angular-type electrodes (here, they are so referred), that have a structure in which two metal rods having sharpened tops are mounted on a ring-shaped conductor. The angular-type electrodes 7 are mounted instead of the waving electrodes 2 in FIG. 1A. The accelerating cavity provided with the angular type electrodes 7 is referred to as an angular electrode type RFQ linac. FIG. 6A is the perspective view showing the outline of a 4-rod electrode type RFQ linac, and FIG. 6B is the expanded perspective view showing the shape of the rod electrodes. In the FIG., 8 is the rod electrodes which are supported by the stems 4 to be assembled in the cylindrical cavity 1 as shown in FIG. 6A. FIG. 7A is its partially cut front view showing a 4 vane type RFQ linac, and FIG. 7B is a cross-sectional view thereof. In the figures, 9 is vanes the top parts of which have the same configurations as the waving electrodes 2, 10 is a loop coupler (radio frequency system) for inputting a radio frequency, 11 is side tuners, and 12 is tuner driving mechanism. FIG. 8 is a cross-sectional view of a Double-H type RFQ linac which has such a structure as the one provided with two open pipes instead of the vanes 9 in FIG. 7A and FIG. 7B, and, as the electrodes, the rod electrodes 8 and so forth are mounted.

Next, the operation will be described. The RFQ linac is the one for focusing and accelerating charged beams by a radio frequency electric field, generally used in the initial stage of a high-energy accelerator for a nuclear test and so forth. Since the RFQ linac is the one for focusing and accelerating charged particles by a radio frequency quadrupole electric field, the shape of the electrodes or the structure of the accelerating cavity is not limited to one. Those shown in FIG. 1A and FIG. 5 to FIG. 8 are typical ones, however, since apparatus relating to the split coaxial RFQ linac shown in FIG. 1A to 1E will be typically described as embodiments of the present invention, the split coaxial RFQ linac shown in FIG. 1A to 1E will be described here in detail.

The waving electrodes 2 in FIG. 1B have waving shapes in the beam axis direction (this waving is referred to as modulation). By applying alternating voltages of the same sign to the opposing pair of the waving electrodes 2, and by applying alternating voltages of the reverse sign to the other pair of the electrodes 2, a quadrupole electric field is generated in the aperture surrounded by the four waving electrodes 2 through which the charged beams are passed. By the quadrupole electric field, a focusing force is applied to the charged beam, and, in addition, since an electric field is generated by the waving shape in the beam advancing direction, the beam is accelerated by this component. Since the waving period must be the value proportional to the product of the wavelength of the alternating voltage and the beam speed (the reason for this will be described later), the waving period is formed to be longer in accordance with the acceleration of the charged beams. Therefore, once the waving electrodes 2 are fabricated, the speed of the charged beams is determined by the frequency of the alternating voltage. Namely, as long as the frequency is not changed, the energy of the beam emitted from the accelerating cavity is not changed. To apply the alternating voltage to the waving electrodes 2, a method is employed in which a radio frequency power is supplied into the accelerating cavity to establish a standing wave (resonance state). This method can efficiently supply the power.

In the following, in the split coaxial cavity, why the voltage as mentioned above develops at the four waving electrodes, and what kind of electromagnetic field is generated, will be described. FIGS. 2A and 2B show a reentrant-type cavity generally used to accelerate charged particles. In this reentrant type cavity, the inner conductor 6 in the coaxial resonant cavity is cut and separated at its center to generate a concentrated electric field in the gap therebetween so that the particles are accelerated by the electric field. The distributions of the electric field and the magnetic field, and the paths of the surface currents are shown in the figure. The potential difference between the cut and separated inner conductors 6 is uniform across the cross section of the cylinder of the inner conductors 6.

FIG. 3A and FIG. 3B show a modification of the above-mentioned reentrant type cavity in which the region of the strong electric field is expanded. The distribution of the electromagnetic field and the current paths are the same as those in the reentrant type shown in FIG. 2A and 2B, and the potential difference between the inner conductors 6 is also constant. FIG. 4A and 4B show a structure in which a pair of the inner conductors is further added, and the waving electrodes 2 are employed instead of the inner conductors 6. By connecting three cavities of this type, an equivalence to the RFQ linac shown in FIG. 1A to FIG. 1E is realized. The electromagnetic field and the current paths are shown in FIG. 1A to 1E, however, the voltage between the waving electrodes is the voltage necessary to generate the already explained quadrupole electric field, and, in addition, is constant in the beam advancing direction. The back plate 3 in FIG. 4A is the one for mechanically reinforce the waving electrodes 2.

In FIG. 1C to 1E, the four waving electrodes 2 are one body or are originally fabricated separately and then combined. In either case, they are one body in the radio frequency sense. Accordingly, by supplying a radio frequency power from an arbitral position of the accelerating cavity, a predetermined potential distribution can be obtained over the whole of the waving electrodes 2. The reason why the connecting surfaces between the electrodes are formed such as A–A′ cross section indicated by arrows and B–B′ cross section indicated by arrows is that only one vacuum exhausting unit is necessary when the cavity is to be made vacuous, that the radio frequency power is easily transmitted throughout the cavity when the radio frequency power is supplied from one portion, and so forth. Even when the portion of the connecting surface other than the portion where the beam passes is completely covered with something, the radio frequency power is transmitted to the other cavity even when the radio frequency power is supplied from one point as long as the waving electrodes are connected. In addition, even when the connecting surfaces, namely, the stems 4, are removed, the voltage distribution between the waving electrodes is the same as the one in the above-mentioned structure, however, in this case, since the electrodes are supported at only one side, if the electrodes are long, they become mechanically instable and therefore are not practical. Generally, to stably fix the electrodes, the back plate 3, which is omitted from the illustration in FIG. 1C to FIG. 1E, is attached to the electrodes.

To efficiently supply a radio frequency power to the such an accelerating cavity as mentioned above, the frequency of the radio frequency power must coincide with the resonant frequency of the accelerating cavity. The resonant frequency in a well-known electric circuit is determined by a product of a capacitance C and an inductance L connected in parallel, and is given by the following expression.

$$2\pi f_r = \frac{1}{\sqrt{LC}}$$

In the case of this accelerating cavity, the capacitance C is given as the sum of a capacitance $C_{vv}$ between the waving electrodes 2 and the capacitance $C_{vs}$ between the waving electrodes 2 and the stems 4. Also, the inductance L is given from $L_s$ obtained from the magnetic field generated to surround the waving electrodes 2 and $L_s$ obtained from the magnetic field surrounding the stem 4, as the following expressions.

$$\frac{L_T}{3} \quad \frac{L_T + 3L_s}{3L_T + \frac{1}{3}L_s}$$

$$L_T = \frac{\mu_0}{2\pi} l_m l_n \frac{r_e}{r_E}$$

Here, $l_m$ is the length of the interval separated by the stems 4, $r_c$ is the inner radius of the cylindrical cavity 1, and $r_E$ is the effective radius of each of the waving electrodes 2. Accordingly, when the frequency of the radio frequency power is previously determined, the gap length between the electrodes and the cross sectional area of the cylindrical cavity 1 must be determined in such a way that the resonant frequency in the accelerating cavity become the same as the radio frequency of the power. Generally, the gap between the electrodes is so determined as to be able to generate a high electric field by a voltage as low as possible. Therefore, the cross section of the cylindrical cavity is determined in such a way that the necessary resonant frequency can be obtained by a capacitance C which is determined by the gap. In the practical fabrication, however, since a fabrication error is always produced, the resonant frequency is slightly shifted. To correct this, generally, a tuner having a metal block to be inserted into and to be withdrawn from the cylindrical cavity 1 is provided, and, by inserting or withdrawing it, the inductance $L_T$ is equivalently changed so that the resonant frequency is finely adjusted. In such an adjusting method, the changed spread of the resonant frequency with respect to the resonant frequency is about 1%.

As the electrodes, other than the waving electrodes 2, there is a case in which the angular electrodes 7 shown in FIG. 5 are employed. In this case, the structure is such that the electrodes of two metal rods having sharpened tops and mounted on ring-shaped conductors are mounted on the upper and lower or right and left back plates 3. As shown in FIG. 5, the angular electrodes; are alternatingly mounted in such a way that certain angular electrodes are mounted on the upper and lower back plates 3, and the next angular electrodes are mounted on the right and left back plate 3, thereby the quadrupole electric field is generated between the angular electrodes 7.

Also, by providing the electrodes as shown in FIGS. 6A and 6B, in the cylindrical cavity 1, a similar quadrupole electric field can be obtained. The potential distribution for this is considered by assuming that the two stems 4 and the two rod electrodes 8 associated therewith are one set. When the roots (opposite to the rod electrodes) of the stems 4 are assumed to be the earth potential, a structure equivalent to the well known coaxial resonator is obtained so that a distribution can be obtained in which the voltage at the root of each stem 4 is zero and the voltage at the center of each rod electrode 8 is maximum. Also, since the capacitance at the rod electrode 8 is very large, the change of the phase at the rod electrode 8 is small so that the potential difference between the rod electrodes 8 is almost constant in the space between the stems 4. Note that FIG. 6B is an expanded perspective view showing only the rod electrodes 8.

Other than those, there is a 4-vane type as shown in FIG. 7A and FIG. 7B. This is the one in which the four vanes 9 each having the top having the same structure as the waving electrode 2 are mounted in the cylindrical cavity 1. Note that, at the both end portions of the cylindrical cavity 1, there are provided spaces, and by the provision of the spaces, it is possible to generate a magnetic field which surrounds the vanes. Thereby, the top portions of the four vanes 9 function as electrodes to focus and accelerate the charged particles. At this time, if the capacitance between the vanes 9 is constant along the beam axis, the voltage between the vanes 9 is also constant. The side tuner 11 in FIG. 7B is provided for the electric field distribution adjustment and the resonant frequency adjustment, and have the same structure as the resonant frequency adjusting tuner previously mentioned a little in the split coaxial RFQ linac. Also in FIG. 7A and FIG. 7B, a loop coupler 10 for supplying a radio frequency power is depicted.

FIG. 8 shows the Double-H type which has a structure including two cleaved pipes instead of the vanes 9, and the rod electrodes 8 shown in FIG. 6B for example are fixed at the cleaved portions.

Now, as described above, the energy of the emitted beam can be varied by changing the resonant frequency (operating frequency). An example of the conventional RFQ linac according to this method will be described in the following.

FIG. 9A is a diagram showing an outline of a conventional variable energy type RFQ linac disclosed in "Acceleration Experiments of a Variable Energy RFQ Driven by an LC-tank Circuit" (collection of papers from page 95 to page 97) published in "Proceedings of the 7th Symposium on Accelerator Science and Technology) held on Dec. 12 to 14, 1989, and FIG. 9B is its equivalent circuit diagram. In the figure, 13 is a tank-type inductance, 14 is a variable capacitance, and 15 is a radio frequency power supply.

In the variable energy type RFQ linac type, the accelerating cavity as a whole is not a resonator, but a resonant circuit is formed by connecting, in parallel with the electrodes, the variable capacitance 14 of lumped constant and the tank-type inductance 13. Since the capacitance 14 of the lumped constant is employed, the power efficiency is bad but there is an advantage in that the resonant frequency can be easily and largely changed.

On the other hand, when a beam passing efficiency is assumed to offer no problem, beams with various energies can be obtained by lowering the radio frequency power in a single accelerating cavity. First, a beam accelerating method in the RFQ linac will be described. Not only the RFQ linac but also any linac for acceleration by a radio frequency power has a periodic structure consisting of a plurality of cells. The length of each cell is equal to the distance in which the phase of the radio frequency power is changed by $\pi$ or $2\pi$. The charged particles are accelerated in all of the cells. Accordingly, the cell length is elongated in accordance with the increase of the speed of the particles due to the acceleration. Generally, the radio frequency phase (synchronized phase $\phi_s$) when a particle passes through the center of each cell is designed to be always constant. Namely, the electrodes are designed in such a way that the change of the phase of the radio frequency power when the particle advances from the center of one cell to the center of the next cell is always $2\pi$ (for the case of the RFQ linac, it is $\pi$ even though it depends on the type of the accelerating cavity).

The above explanation is for the synchronized particles, however, since the incident beams have limited lengths even when they are previously bunched, the phases of the radio frequency power at the center of each cell are different depending on the particles so that the increases in energy are different. Therefore, only the synchronized particles are accelerated in accordance with the design, but the energies of the asynchronized particles are gradually shifted from the designed values.

If, however, the accelerating phase ($\phi_s$) of the radio frequency for the synchronized particles is set between $-90$ degree and 0 degree of the cosine wave, the asynchronized particles other than the synchronized particles are accelerated with vibrations in the sense of energy and phase around the synchronized particles. The orbit drawn on a phase-energy plane by the outer-most particle is called as a separatrics. The particles outer thereof do not oscillate in phase so that, along with the advance of the particles, there are positions through where they pass with phases of decreasing speeds. As a result, the particles outer of the outer-most particle are emitted without being accelerated. The separatrics is maximum when $\phi_s=90$ degrees (but the particles are not accelerated when averaged), and is disappeared when $\phi_s=0$ degrees. Namely, when $\phi_s=0$ degrees, the synchronized particles are accelerated most efficiently, and the particles around them repeat to be accelerated and decelerated so that the average accelerating voltage becomes zero.

Even when the electrode voltages are changed by changing the radio frequency power inputted into the accelerating cavity, the speeds (or energy) of the synchronized particles are not changed. This will be described in the following. The increment of the energy of a particle in each cell is expressed as the following expression.

$$\Delta W \propto V_0 \cos \phi_s$$

Here, $V_0$ is a voltage between the electrodes, and T is a coefficient taking into account the electric field distribution in each cell and the change of the radio frequency phase when the particle passes through the cell. Each cell length is determined based on the energy increase obtained from the above expression, thereby the electrodes are designed. Accordingly, the synchronized particle is the particle which obtains the designed value $\Delta W$ when it passes through one cell. Therefore, even when $V_0$ is changed, the synchronized particle is accelerated in such a way that the above expression $\Delta W$ is constant, so that $\phi_s$ changes depending on the change of $V_0$. Here, the change of the coefficient T is neglected. Namely, a particle incident at a time of a changed $\phi_s$ becomes a synchronized particle, and the original synchronized particle becomes an asynchronous particle to be accelerated with vibration around the new synchronized particle in the sense of energy.

When the electrode voltage is raised, $\phi_s$ infinitely closes with 90 degrees. By contrast, when the electrode voltage is lowered, since the separatrics disappears at $\phi_s=0$ degrees, the situation in which the particle is not accelerated is not changed even when the voltage is lowered below the voltage at which $\phi_s=0$ degrees. Note that the acceleration is not effected as a result of repeating accelerations and decelerations. Therefore, this case is applied to a linac in which several times or more of the phase vibrations are carried out. In a linac in which the phase vibration is about one or less, the energy spread of the emitted beam is large but the central energy is changed.

Next, a description will be given with respect to the RFQ linac. In the RFQ linac, generally, continuous beams are inputted, and are bunched along with an acceleration ($\phi_s$ is at first 90 degrees and is gradually approached to the final value), and, after $\phi_s$ reaches the final value, they are accelerated under the condition in which $\phi_s$ is constant. The region where $\phi_s$ is constant is referred to as an accelerated portion. According to this method, a more number of particles can be accelerated. The state at this time is shown in FIG. 10. In the figure, the abscissa represents a phase of the radio frequency, and the ordinate represents the energy (Ein: incident energy, Eex: emitting energy). In the left side of the figure, a normal acceleration is shown from which it will be seen that continuous beams are bunched along with an acceleration. In addition, due to the phase vibration, the bunched beams have a certain energy width.

It has already been described that $\phi_s$ is changed in accordance with the change of the accelerating voltage from the designed value. When the accelerating voltage is raised, $\phi_s$ changes to the direction of $-90$ degrees, and when it is lowered, $\phi_s$ changes to the direction of 0 degrees. Namely, when the accelerating voltage becomes too low, the separatrics disappears in a partial region, for example, in the accelerated portion. In the right side in FIG. 10, the state of the disappear of the separatrics when the accelerating voltage is lowered by 20% is shown. Accordingly, by designing the RFQ linac in such a way that the phase vibration in the accelerated portion is one time or less, the energy spread is expanded so that it is sufficient to use only the particles emitted with the necessary energy. In this case, a number of particles are forced out from the separatrics until they reach the accelerated portion so that the energy of the emitted beams are extremely expanded, resulting in that the number of particles within a unit energy width becomes extremely small.

Since the conventional RFQ linac is constructed as above, it is difficult to largely change the speed, i.e., energy, of the emitted beam. Even when it can be changed, there is a problem in that the accelerating cavity has a bad power efficiency, or the beam current per unit energy width is extremely small. When it is used in a portion where variable energy is not necessary such as in an initial stage of a high energy accelerator for a nuclear test, that is not a particular problem. When it is used in a portion where the energy is required to be largely varied for the same charged particles, such as an ion implanting apparatus and so forth for example, however, there is a problem in that such an RFQ linac cannot be used alone.

SUMMARY OF THE INVENTION

The present invention is accomplished to eliminate the above-mentioned problems, and has an object to provide an RFQ linac which can arbitrarily vary the energy without lowering the power efficiency of the accelerating cavity and without making the beam current per unit energy width to be extremely small.

According to the first aspect of the present invention, for achieving the above-mentioned object, there is provided a variable energy radio frequency quadrupole linac having an accelerating cavity provided with electrodes therein, for focusing and accelerating charged particles by radio frequency quadrupole electric field generated between the electrodes, wherein, the accelerating cavity is divided by a plane substantially perpendicular to the beam direction of the charged particles and in a radio frequency sense into upstream accelerating cavity and a downstream accelerating cavity, and the radio frequency power level in the downstream accelerating cavity is made to be lower in than the radio frequency power level in the upstream accelerating cavity.

As stated above, in the accelerating cavity in the first aspect of the present invention, the radio frequency power level in the downstream accelerating cavity is made to be lower than the radio frequency power level in the upstream accelerating cavity, thereby the charged particles are accelerated normally in the upstream accelerating cavity, and the condition of phase vibration is removed only in the downstream accelerating cavity, so that beams of different energies can be emitted with a small energy spread.

According to the second aspect of the present invention, the ratio between the lengths of the upstream accelerating cavity and the downstream accelerating cavity in the beam direction is one to one.

As stated above, in the variable energy RFQ linac according to the second aspect of the present invention, by making the dividing ratio between the upstream accelerating cavity and the downstream accelerating cavity is made to be one to one, the radio frequency power losses in the two accelerating cavities can be made to be nearly equal.

According to the third aspect of the present invention, the electrodes are designed in such a way that the synchronizing phase in the downstream accelerating cavity is kept to be constant.

As stated above, in the variable energy RFQ linac according to the third aspect of the present invention, by making the synchronizing phase in the downstream accelerating cavity is made to be constant by the electrodes, the radio frequency power levels at which the separatrics are disappeared can be made to be nearly equal for all cells in the downstream accelerating cavity.

According to the fourth aspect of the present invention, the variable energy RFQ linac further comprises a first radio frequency system for supplying a radio frequency power to the upstream accelerating cavity, and a second radio frequency system for supplying radio frequency power to the down stream accelerating cavity, the first radio frequency system being a self excited system, and the second radio frequency system being a separately excited system operated by a frequency determined by a resonant frequency in the upstream accelerating cavity 31.

As stated above, in the radio frequency systems in the accerelating cavity divided into two according to the fourth aspect of the present invention, the first radio frequency system is a self excited system, and the second radio frequency system is a separately excited system operated by a frequency determined by a resonant frequency in the upstream accelerating cavity, thereby, even when the resonant frequency in the separately excited system is changed due to the change of temperature and so forth, the frequency generated by a signal generating unit is changed depending on the change of the resonant frequency, so that only one of the two divided accelerating cavities may have a frequency tuner system for keeping the resonant frequency of the accelerating cavity to be equal to the output frequency of the signal generating unit.

According to the fifth aspect of the present invention, the electrodes in the accelerating cavity are cut and separated by the plane substantially perpendicular to the beam direction, and further comprising a separating plate provided between the cut and separated electrodes, the separating plate being made of conductor having a beam passing window, and covering the cross section of the accerelating cavity, whereby the accerelating cavity is divided by a plane substantially perpendicular to the beam direction into two in the high frequency sense.

The separating plate in the variable energy RFQ linac according to the fifth aspect of the present invention minimizes the power loss in the accelerating cavity.

According to the sixth aspect of the present invention, the separating plate defined in the fifth aspect of the present invention is provided with holes, each of the holes having a so small size that the radio frequency power cannot be passed through the holes.

As stated above, in the variable energy RFQ linac according to the sixth aspect of the present invention, by providing, in the separating plate defined in the fifth aspect of the present invention, the holes through which the radio frequency power cannot be passed, the separated cavities can be deemed as a single cavity in a sense of vacuum so that only one set of exhaust unit may be provided. Further, by making the holes to be long holes arranged radially on the separating plate, the electric resistance can be reduced because the holes are deemed to be opened in the current conducting direction, since the radio frequency currents on the separating plate tend to conduct from the central portion to the outer side or vise versa.

According to the seventh aspect of the present invention, the variable energy RFQ linac further of the fifth aspect of the present invention comprises a vacuum exhaust duct, the upstream accelerating cavity and the down accelerating cavity having exhaust ports respectively, the vacuum exhaust duct being branched to be connected to the exhaust ports.

As stated above, according to the seventh aspect of the present invention, by providing the vacuum exhaust duct branched to be connected to the upstream accelerating cavity and the downstream accelerating cavity, it is not necessary to provide a hole in the separating plate so that the power loss in the separating plate can be reduced.

According to the eighth aspect of the present invention, the length between the cut and separated electrodes defined in the fifth aspect of the present invention is even times as much as the length of one cell in the accelerating cavity, the length of the one cell being the distance through which the phase of the radio frequency power is changed by $\pi$.

As stated above, according to the eighth aspect of the present invention, by making the length between the cut and separated electrodes to be even times as much as the length of one cell, the beam can be inputted into the downstream accerelating cavity with the phase of the beam emitted from the upstream accerelating cavity, so that the adjustment between the radio frequency phases of the two accelerating cavities is not necessary.

According to the ninth aspect of the present invention, the variable energy RFQ linac further comprises phase adjusting means for relatively changing the phase of the radio frequency power in the upstream accelerating cavity and the phase of the radio frequency power in the down stream accelerating cavity.

As stated above, according to the ninth aspect of the present invention, by providing the phase adjusting means, the phase of the radio frequency power in the upstream accelerating cavity and the phase of the radio frequency power in the down stream accelerating cavity can be relatively changed so that the distance between the cut and separated electrodes can be selected arbitrarily, resulting in that the beam loss at the position where the electrodes are cut and separated can be minimized.

According to the tenth aspect of the present invention, the beam passing window of the separating plate has a size substantially equal to the size of the minimum beam aperture of cells before and after the separating position at which the electrodes are cut and separated.

As stated above, according to the tenth aspect of the present invention, by making the size of the beam passing window of the separating plate to be substantially equal to the size of the minimum beam aperture of cells as mentioned above, the relation between the independence of the two accerelating cavities in the radio frequency sense and the beam loss at the position where the electrodes are cut and separated can be optimized.

According to the eleventh aspect of the present invention, the electrodes are waving electrodes having tops and bottoms, the position at which the electrodes are cut and separated being the position of one of the tops or the bottoms.

As stated above, according to the eleventh aspect of the present invention, by making the position at which the electrodes are cut and separated to be the position of one of the tops or the bottoms, the leakage electric field at the position where the electrodes are cut and separated can be minimized so that the influence of the leakage electric field on the beam can be minimized.

According to the twelfth aspect of the present invention, in the periphery of the beam passing window of the separating plate, a thin plate region in which the thickness of the separating plate is made to be thin is formed.

As stated above, according to the twelfth aspect of the present invention, by making the thickness of the separating plate to be thin in the periphery of the beam passing window, the distance between the cut and separated electrodes can be minimized without deteriorating the mechanical strength of the separating plate.

According to the thirteenth aspect of the present invention, the distance between the separating plate and each of the electrodes is equal to or larger than the minimum distance between adjacent electrodes.

As stated above, according to the thirteenth aspect of the present invention, by making the distance between the separating plate and each of the electrodes to be equal to or larger than the minimum distance between adjacent electrodes, the beam loss is reduced.

According to the fourteenth aspect of the present invention, the variable energy radio frequency quadrupole linac is a 4 vane type RFQ linac, the distance between the separating plate and each of the electrodes is equal to or larger than half of the minimum distance between adjacent electrodes.

As stated above, according to the fourteenth aspect of the present invention, in the 4 vane type RFQ linac, by making the distance between the separating plate and each of the electrodes is equal to or larger than half of the minimum distance between adjacent electrodes, the beam loss can be reduced without a problem of a discharge limit.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DESCRIPTION OF THE PREFERRED EMBODIMENTS

Embodiment 1.

Figure 11:
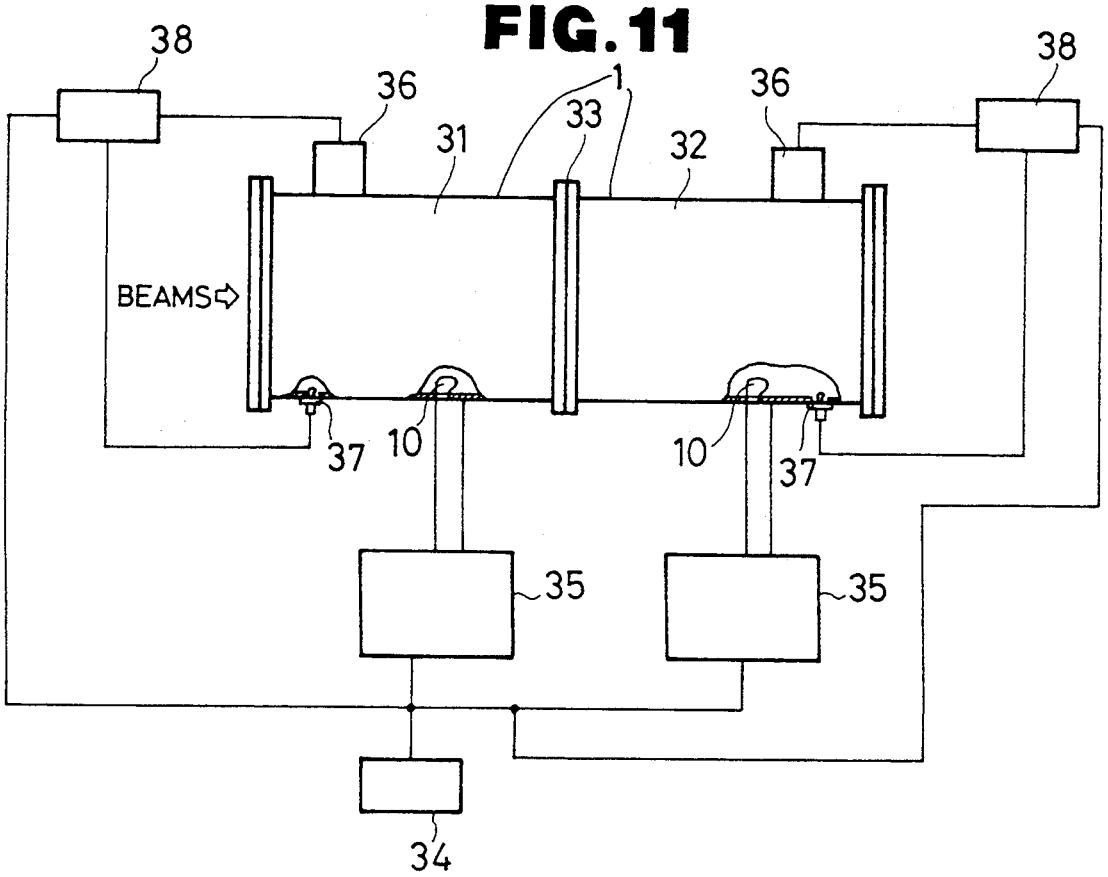
FIG. 11 is a constructional diagram showing a variable energy RFQ linac according to an embodiment 1 of the present invention.
Figure 10:
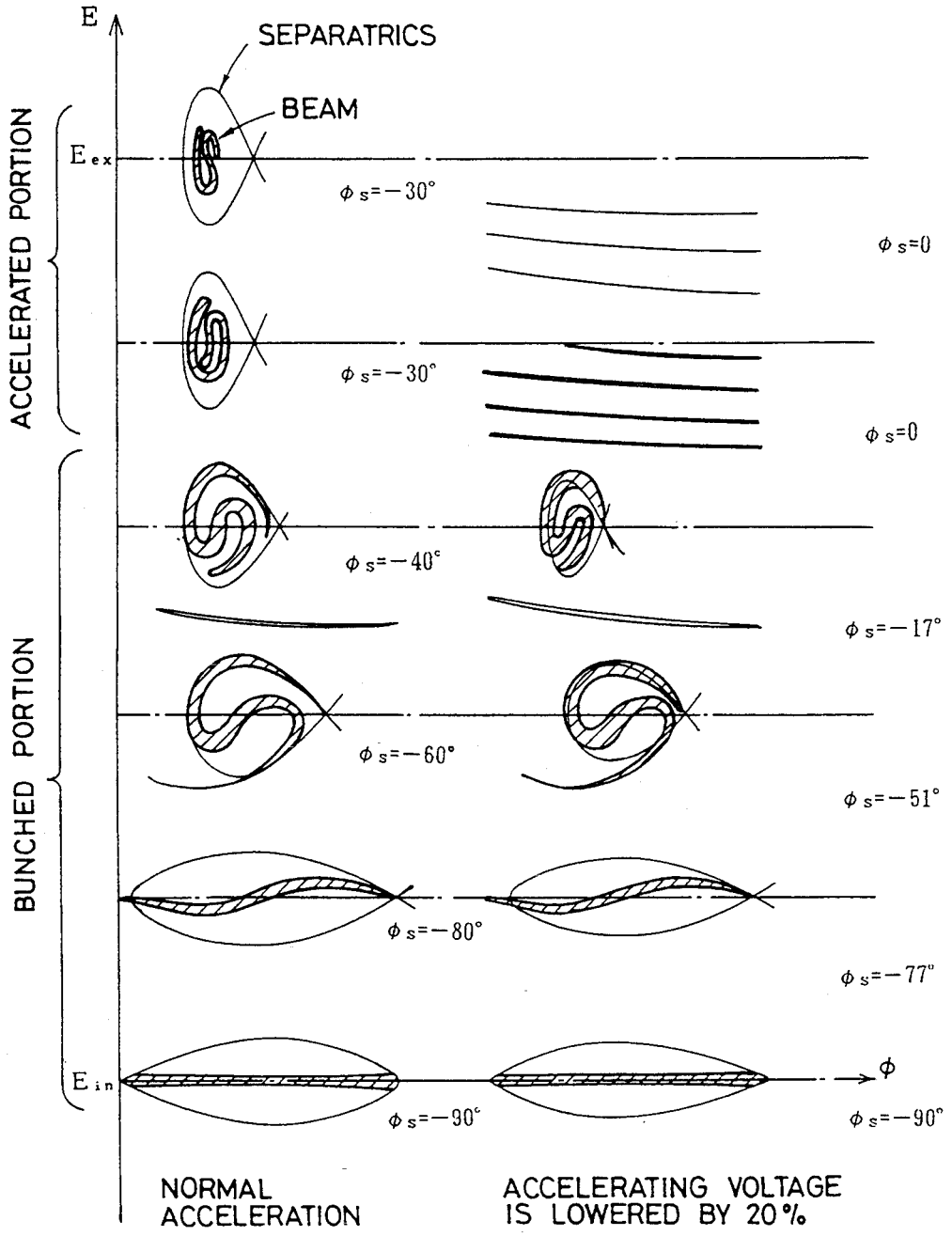
FIG.10 (PRIOR ART)
FIG. 10 is an explanatory diagram showing the state in which charged beams are bunched and accelerated in the conventional RFQ.

In the following, an embodiment of the present invention will be described with reference to the drawings. FIG. 11 is a construction diagram showing a variable energy RFQ linac according to an embodiment of the first and third aspect of the present invention. In the figure, reference numeral 1 is a cylindrical accelerating cavity, 31 is a cylindrical upstream accelerating cavity, 32 is a cylindrical downstream accelerating cavity connected to the upstream accelerating cavity 31, and 33 is a flange for connecting these accelerating cavities 31 and 32. The cylindrical accelerating cavity 1 is divided by a plane 40 substantially perpendicular to the beam direction of the charged particles and in a radio frequency sense into the upstream accelerating cavity 31 and the downstream accelerating cavity 32. Reference numeral 34 is a signal generator for generating a radio frequency signal of an operating frequency nearly equal to the resonant frequency of the accelerating cavities 31 and 32, and 35 is radio frequency amplifiers (radio frequency system) for amplifying the radio frequency signal from the signal generator 34 and for supplying the amplified signal to loop couplers 10 for the accelerating cavities 31 and 32. Reference numeral 36 is frequency tuners (radio frequency system) for correcting deviations in the resonant frequency due to fabrication errors and for correcting changes in the resonant frequency accompanied by changes in structure of the accelerating cavities 31 and 32 due to a temperature change after fabrication, 37 is monitor loops (radio frequency system) for monitoring radio frequency levels in the accelerating cavities 31 and 32, and 38 is tuner control units (radio frequency system) for controlling the frequency tuners in such a way that the phase difference between the signals from the monitor loop 37 and the signal generator 34 is kept constant. Note that, in the interiors of the accelerating cavities 31 and 32 of this variable energy RFQ linac, the waving electrodes 2 in the conventional example shown, for example, in FIGS. 1A to 1E, are provided.

Next, the operation will be described. Each of the interiors of the accelerating cavities 31 and 32 has the structure shown in FIG. 1C for example for the conventional example, and the charged beams pass through the waving electrodes 2. Here, the shape of the cross section of the accelerating cavities 31 and 32 is not limited to a circle but may be, for example, a square. The upstream accelerating cavity 31 and the downstream accelerating cavity 32 are independent from each other in the sense of radio frequency so that the radio frequency levels (electrode voltage levels) in the respective accelerating cavities 31 and 32 can be independently adjusted by the radio frequency amplifiers 35 connected to the respective cavities. Namely, the accelerating cavity 1 looks like a one accelerating cavity for the sake of appearance, however, it includes two divided cavities 31 and 32 in the sense of radio frequency.

Figure 12:
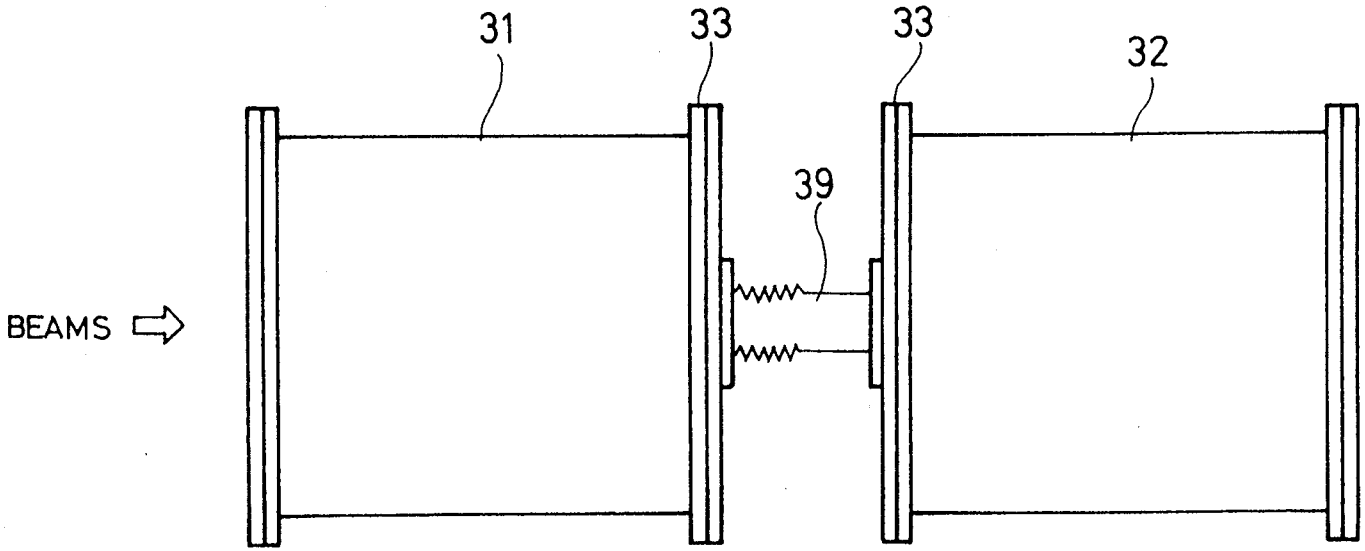
FIG. 12 is a constructional diagram showing an accelerating cavity according to an example of an inappropriate application of the present invention.

In this connection, to divide the accelerating cavity 30, a method may be considered by which, as shown in FIG. 12, completely independent two accelerating cavities 31 and 32 are coupled by a vacuum duct 39. Generally, however, since the RFQ linac is used in a low energy (low speed) region, and since a strong focusing force is applied to the charged beams, the charged beams are expanded immediately after departing from the accelerating cavity. Therefore, if the method shown in FIG. 12 is employed, it will be necessary to provide a focusing magnet around the vacuum duct 39. In addition, since the bunch is expanded, a certain amount of bunching must be effected again in the downstream accelerating cavity 32 so that, not only the design of the electrodes becomes complex, but also the apparatus is not efficient.

The coupling part shown in FIG. 11 may be considered as the one for directly coupling the upstream accelerating cavity 31 and the downstream accelerating cavity 32 without using the vacuum duct 39 shown in FIG. 12, or may be considered as the one which is a one-body cavity, the interior of which is separated into the upper streams accelerating cavity 31 and the downstream accelerating cavity 32 in the sense of radio frequency. The method for the division is not limited.

Here, in the embodiment 1, the radio frequency system is a general one in which the signal from the signal generator 34 for generating a radio frequency signal is amplified by the two radio frequency amplifiers 35 and are inputted into the upstream accelerating cavity 31 and the downstream accelerating cavity 32. In this connection, the radio frequency power supply 15 shown in the conventional example is a one unit including this signal generator 34 and the radio frequency amplifiers 35. The electrical couplings between the radio frequency amplifiers 35 and the accelerating cavities 31 and 32 are generally realized by the loop couplers 10.

The frequency tuners 36 have, for example, metal blocks to be inserted into or to be drawn out from the accelerating cavities 31 and 32 respectively, the principle of which is the same as that of the conventional side tuners 11. The number of the frequency tuners 36 is not limited to one. The frequency tuners 36 are for correcting an error in the resonant frequency due to a fabrication error and so forth in the accelerating cavities 31 and 32, and for correcting a fluctuation of the resonant frequency generated due to a change of the temperature and so forth during an operation. With respect to the error of the resonant frequency due to the fabrication error, since it is sufficient to correct the error only one time after the fabrication, the frequency tuners 36 may be a fixed type. The fluctuation due to the temperature change during an operation, however, must be corrected at any time so that it must be a movable type. With respect to the correcting method here, the phase difference between the radio frequency signal outputted from the signal generator 34 and the radio frequency in the accelerating cavities 31 and 32 are always measured, and the frequency tuners 36 are inserted into or drawn out from the accelerating cavities 31 and 32 so as to keep the phase difference to be a certain constant value. Namely, this method utilizes the principle in which the above-mentioned phase difference changes in accordance with the change of the resonant frequency in the accelerating cavities 31 and 32. The detection of the phase difference and the control of the frequency tuners 36 are carried out by the tuner control unit 38.

Figure 13:
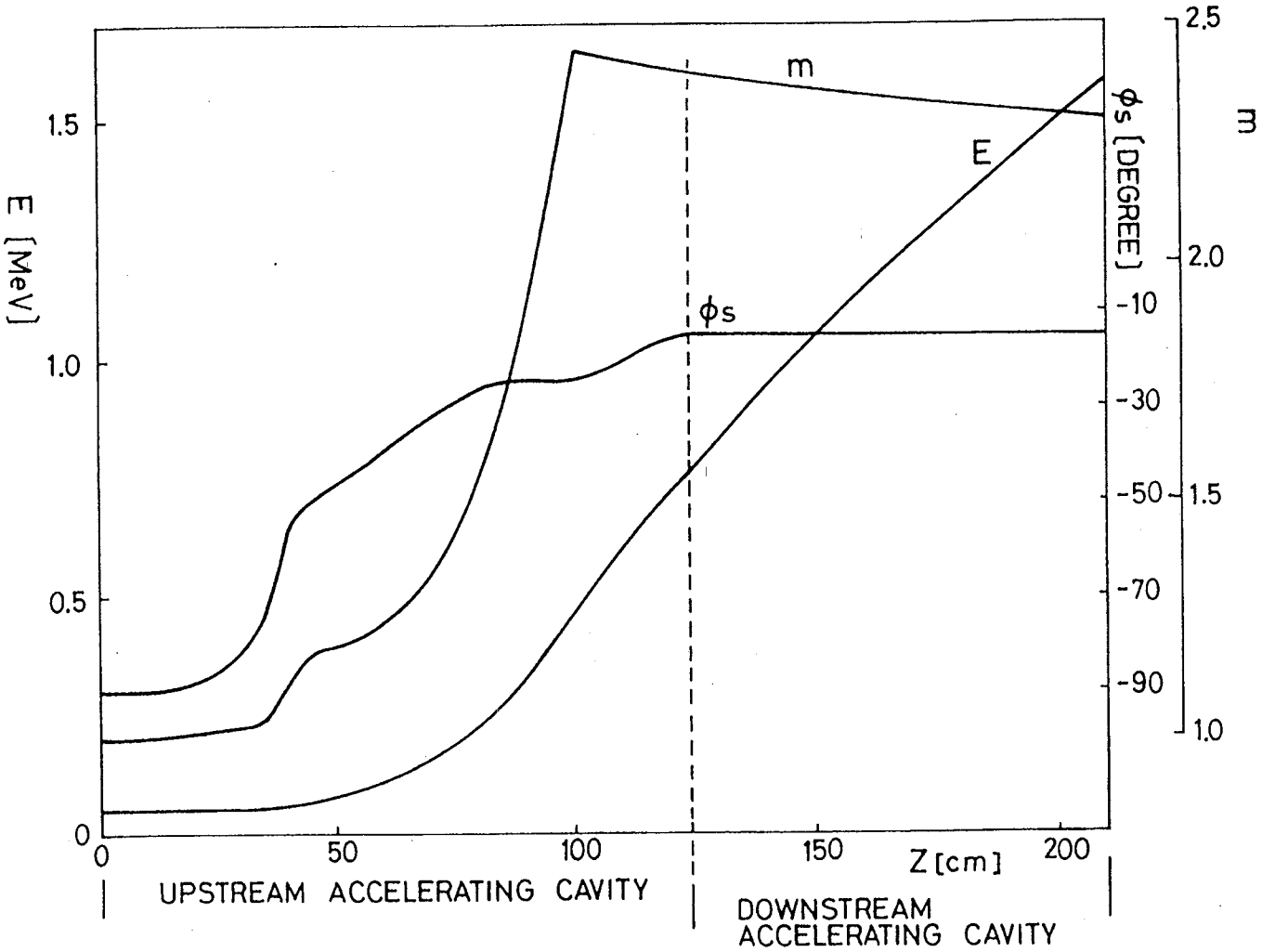
FIG. 13 is an explanatory diagram showing, in the embodiment 1, an example of electrode parameters along the beam axis and calculated by using waving electrodes as an example, and the energy at that time.

Next, an example of the beam simulation result using the above-mentioned accelerating cavity will be described. First, the electrodes are normally designed for the maximum emitting energy. Here, FIG. 13 is an explanatory diagram showing electrode parameters along the beam axis and the change of the beam energy, namely, showing an example of the electrode parameters along the beam axis and the beam energy at that time when a calculation is done using the waving electrodes 2 as an example. In this connection, the accelerated particle is assumed to be one charge of phosphorus (P, the mass number is 31), and the operating frequency is assumed to be 25 MHz. Here, m is an amount expressing the degree of the waving of the electrodes. When there is no waving, m=1, and in this case, the electric field component (acceleration component) in the beam axis direction is not present. The larger the depth of the wave, the larger the value m and the acceleration component.

Also, $\phi_s$ is a synchronizing phase which starts from −90 degrees so as to efficiently capture the direct current beams, and which is kept to be a constant value after the beams are being bunched. How to change the synchronizing phase $\phi_s$ during bunching differs depending on what kind of performance is necessary, and since this is not directly related to the present invention, the description is omitted here. In this embodiment, however, a specific method is employed in which, once a bunching is effected at a synchronizing phase $\phi^s=-25$ degrees, $\phi^s$ is changed to be −15 degrees, and after this, it is kept constant. This is because the calculation uses a program for calculation provided with a limiting condition on the method for changing the synchronizing phase $\phi_s$, and if the calculation is effected under the synchronizing phase of −15 degrees after the bunching, the result is that there is no normal solution, and therefore, the calculation is effected under the value of −25 degrees. Here, the smaller the value of the synchronizing phase $\phi_s$, the smaller the separatrics so that a beam loss tends to be easily generated for a design fabrication error and so forth. Therefore, in general, the final value is selected to be around a value from −30 degrees to −25 degrees. The value of −15 degrees, however, is effective in the variable energy RFQ linac according to the present embodiment, because, the smaller the value, the larger the accelerating efficiency, and the separatrics can be eliminated by a slight decrease of the electrode voltage.

Note that the electrode voltage (the voltage between the electrodes) is assumed to be constant along the beam axis. The accelerating voltage, however, is zero when the value m shown in FIG. 13 representing the degree of the waving of the waving electrodes 2 is 1. The larger the value m, the larger the accelerating voltage becomes. Therefore, the accelerating voltage changes along the beam axis. This is to effectively perform the bunching.

Figure 14:
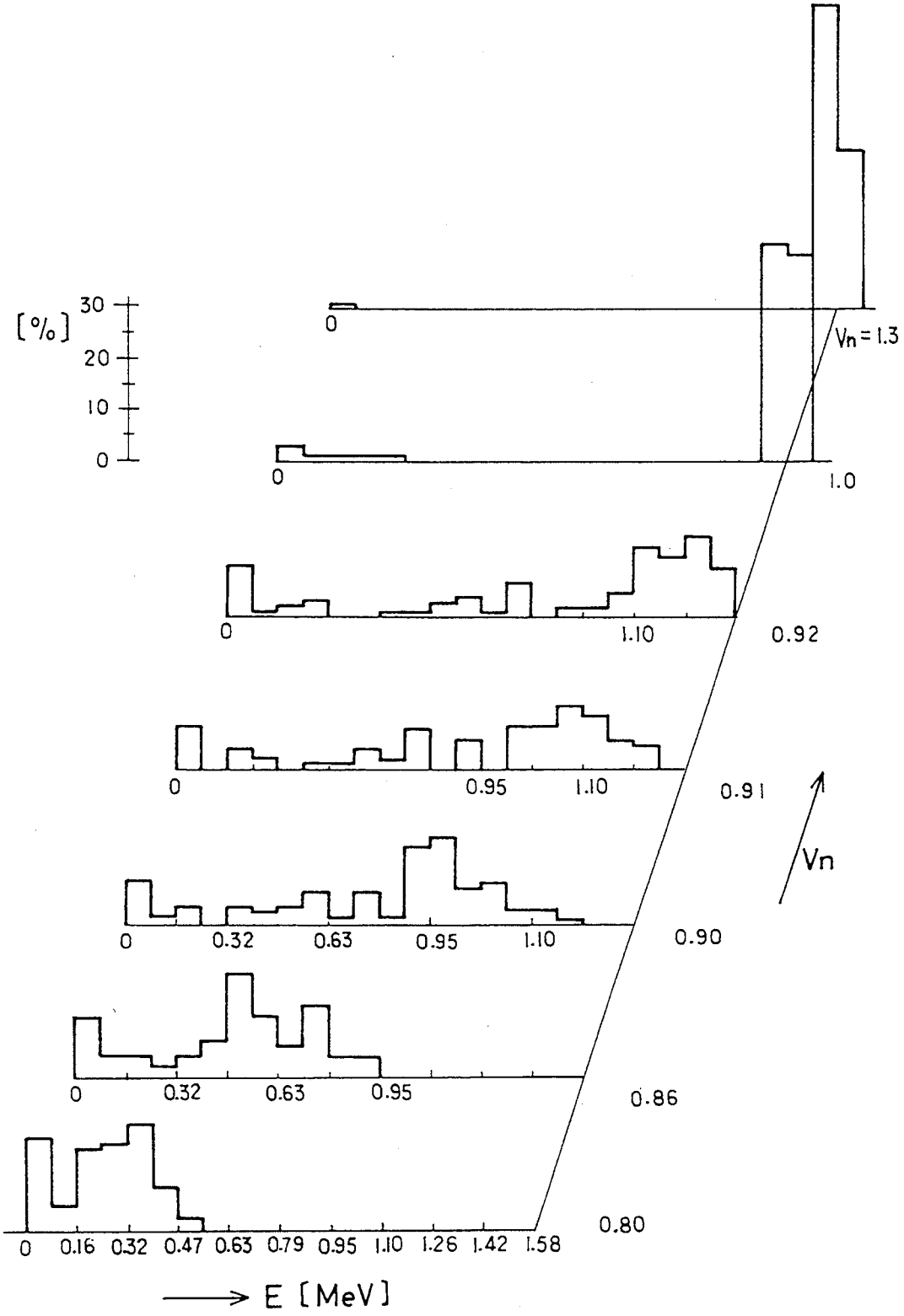
FIG. 14 is an explanatory diagram showing an energy distribution of output beams when the electrodes are not divided and the electrode voltage is changed totally in the example of the calculation shown in FIG. 13;.
Figure 15:
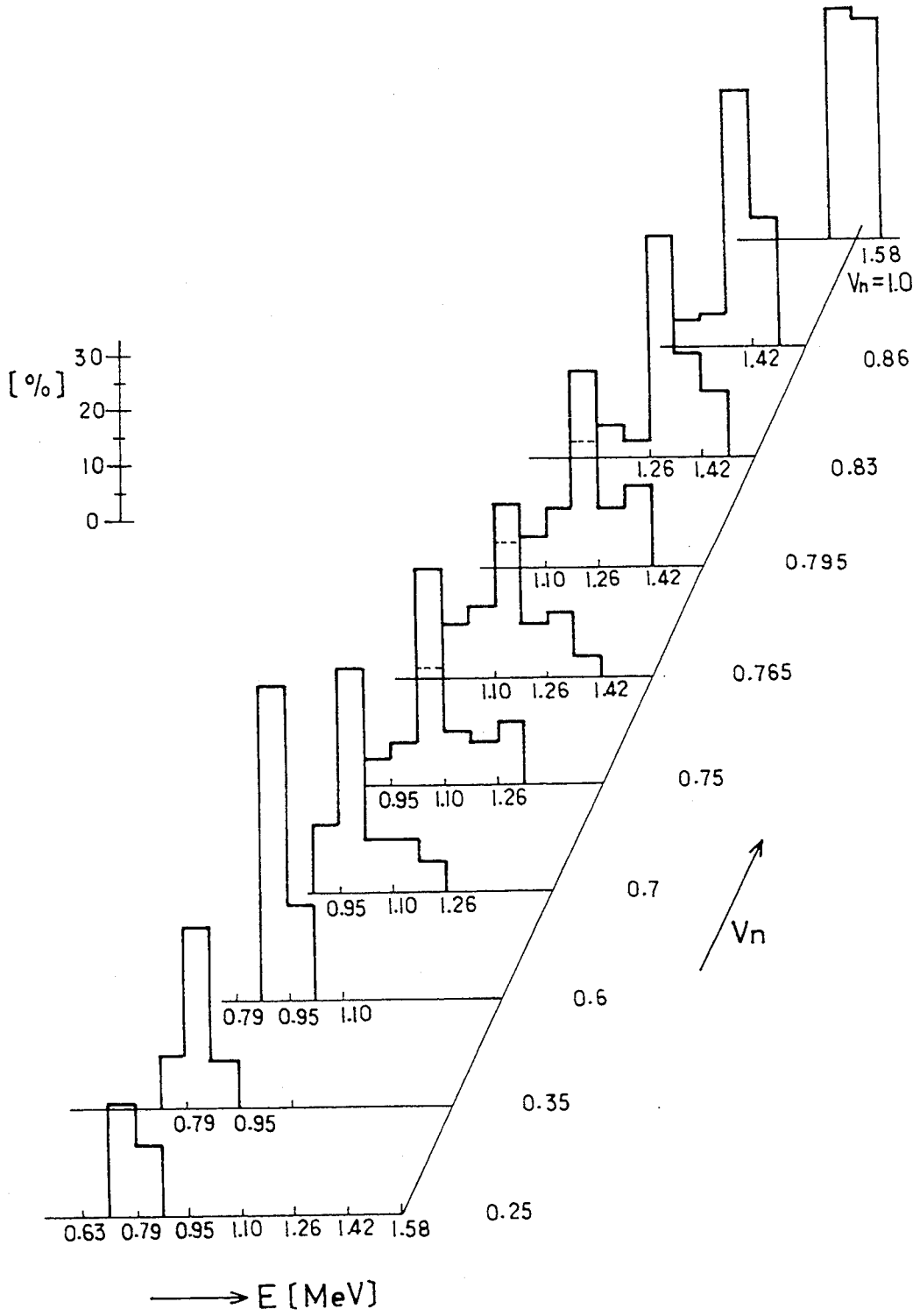
FIG. 15 is an explanatory diagram showing an energy distribution of output beams when the electrode is divided and when the electrode voltage of only the downstream accelerating cavity is changed.
Figure 16:
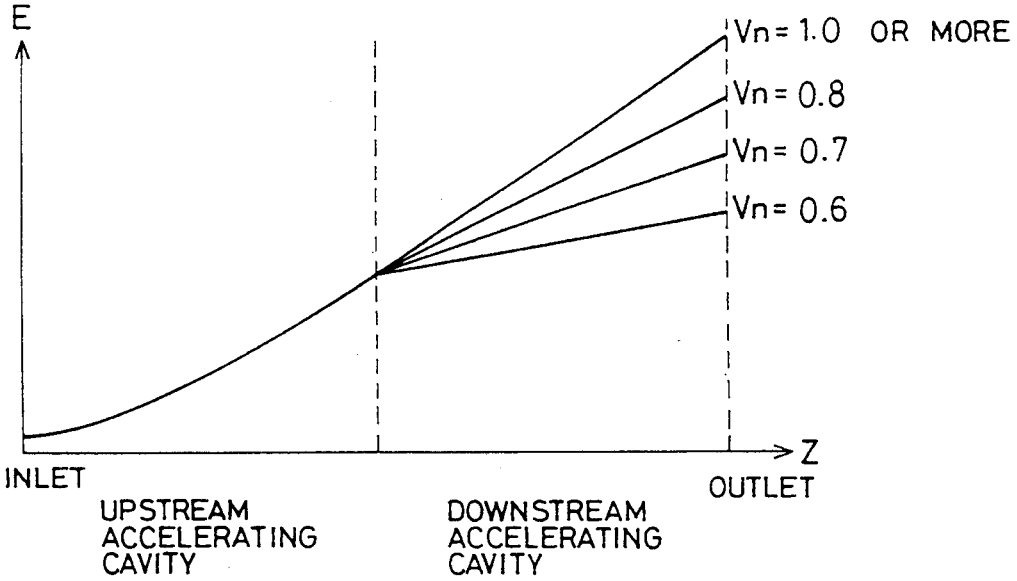
FIG. 16 is an explanatory diagram showing a change of the beam energy along the beam axis when the electrode voltage of only the downstream accelerating cavity shown in FIG. 15 is changed.

FIG. 14 is an explanatory diagram showing an energy distribution of the output beams when a single cavity is not divided in the sense of radio frequency by electrode parameters, and the electrode voltage is changed in both of the upstream accelerating cavity 31 and the downstream cavity 32. FIG. 15 shows an energy distribution of the output beams when only the electrode voltage of the downstream accelerating cavity is changed. FIG. 16 shows the change of the beam energy to be able to see easily along the beam axis when the electrode voltage is lowered.

When the cavity is not divided in the sense of radio frequency by the electrode parameters but the electrode voltage is changed throughout the cavity, namely, when the radio frequency power level in a single cavity mentioned in the conventional example is changed, the energy distribution of the output beams is as shown in FIG. 14. In FIG. 14, the abscissa represents the energy of the emitted beams, and the ordinate represents the beam strength. The results of the calculations performed with several electrode voltages are shown. $V_n$ in the figure is a normalized value with respect to the electrode voltage (designed value) by which the maximum emitting energy can be obtained, and Vn=1 is the designed value. The calculation was effected with respect to hundred particles, and the number of particles which are present in each energy interval of 10% of the maximum emitting energy (1.58 Mev) is plotted. Accordingly, in this case, since the whole number of the particles is 100, it has the same meaning as %.

From FIG. 14, it will be seen that, as the value Vn decreases, the energy is lowered but the energy spread is expanded. When the charged beams are used for ion implantation, the depths of the implanted ions have a large width so that only the ions with a certain allowable energy spread are used, naturally resulting in that the number of ions which can be used is small. In addition, since the energy distribution of the beams is largely varied in accordance with a slight change of the electrode voltage, the control of the radio frequency system is difficult. FIG. 14 also shows the results when the electrode voltage is raised. It will be seen that the central energy is almost unchanged.

Figure 1A:
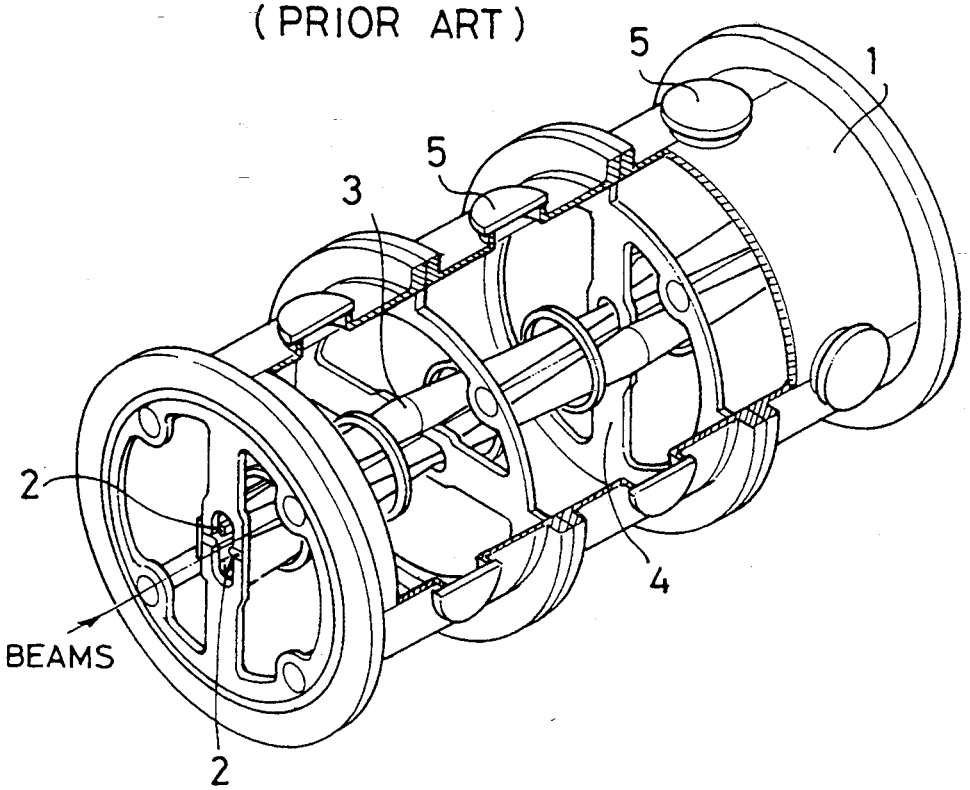
FIG.1A (PRIOR ART)
FIG. 1A is a partially cut perspective view showing a conventional split coaxial RFQ linac.
Figure 1B:
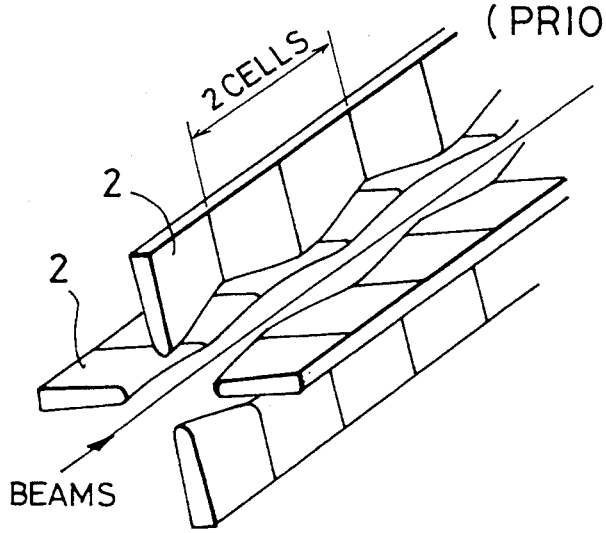
FIG.1B (PRIOR ART)
FIG. 1B is a perspective expanded view showing the waving electrodes in the split coaxial RFQ shown in FIG. 1A.
Figure 1C:
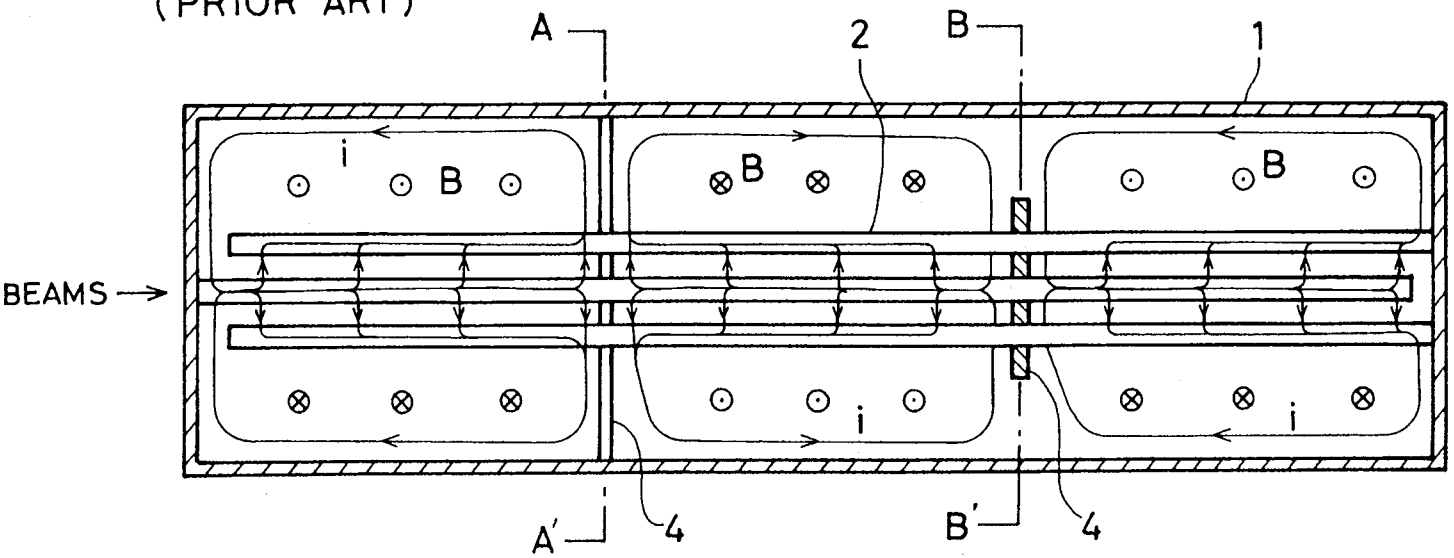
FIG. 1C (PRIOR ART)
FIG. 1C is a general cross-sectional view of the conventional split coaxial RFQ linac shown in FIG. 1A together with current and magnetic field paths.
Figure 1E:
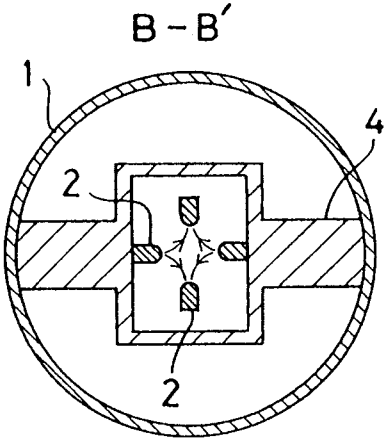
FIG. 1E (PRIOR ART)
FIG. 1E is a cross-sectional view along a line B–B′ in FIG. 1C.
Figure 1D:
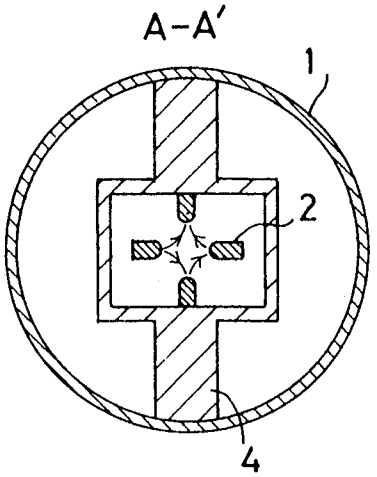
FIG. 1D (PRIOR ART)
FIG. 1D is a cross-sectional view along a line A–A′ in FIG. 1C.
Figure 2B:
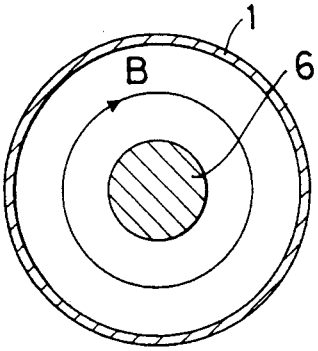
FIG. 2B (PRIOR ART)
FIG. 2A and FIG. 2B are cross-sectional views showing a conventional reentrant type accelerating cavity.
Figure 2A:
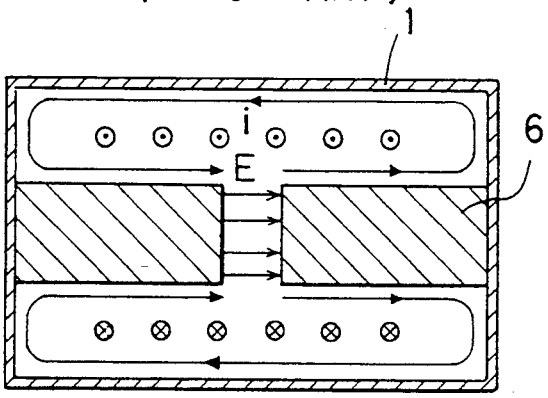
FIG. 2A (PRIOR ART)
Figure 3B:
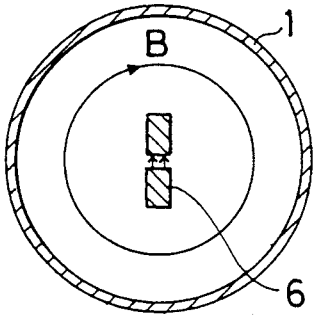
FIG. 3B (PRIOR ART)
FIG. 3A and FIG. 3B are cross-sectional views showing a conventional reentrant type accelerating cavity in which the inner body in FIGS. 2A and 2B is modified.
Figure 3A:
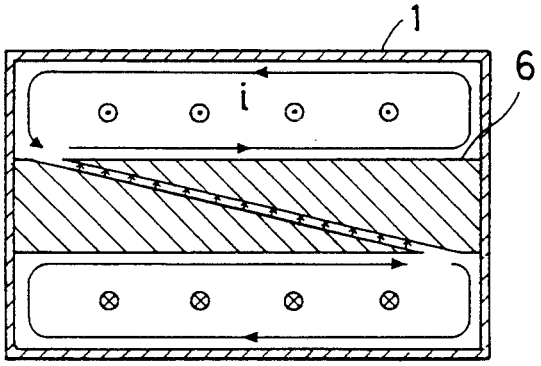
FIG. 3A (PRIOR ART)
Figure 4B:
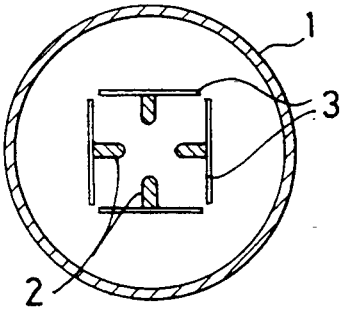
FIG. 4B (PRIOR ART)
FIG. 4A and FIG. 4B are cross-sectional views of a conventional 4 electrode cavity showing the principle of the split coaxial cavity.
Figure 4A:
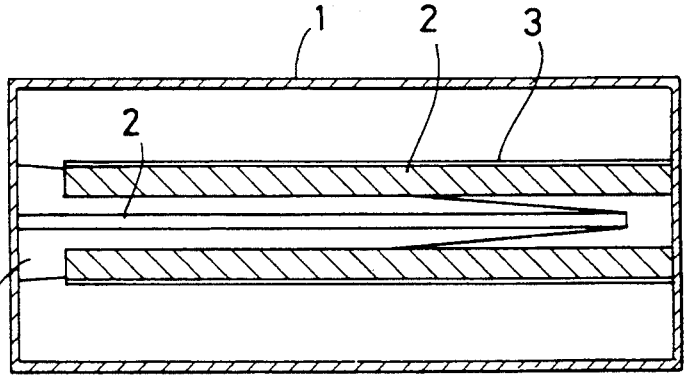
FIG. 4A (PRIOR ART)
Figure 4A:
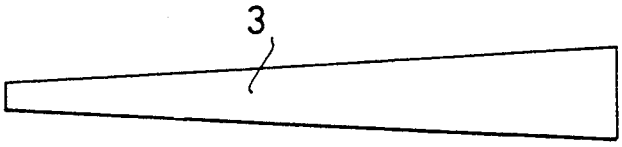
FIG. 4A (PRIOR ART)
Figure 5:
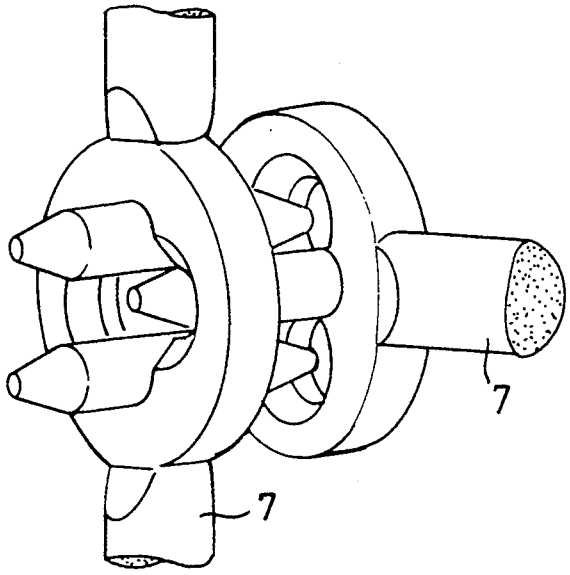
FIG. 5 (PRIOR ART)
FIG. 5 is a perspective view showing an electrode part of a conventional angular electrode type RFQ linac.
Figure 6A:
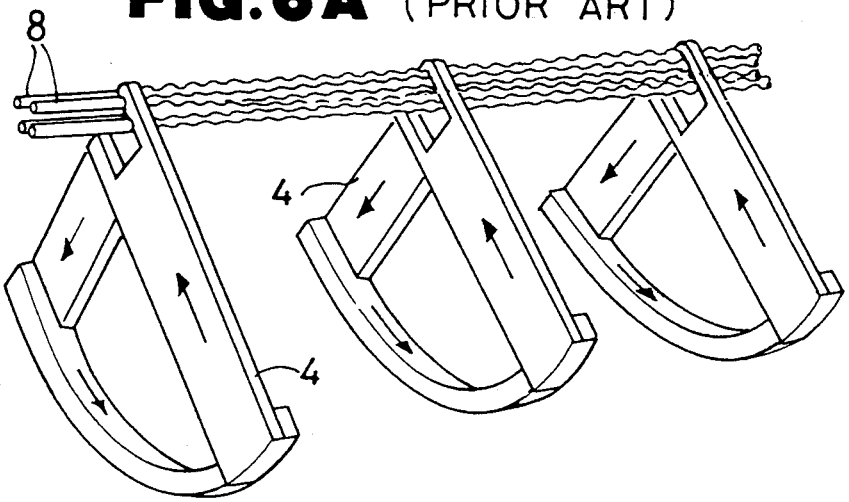
FIG. 6A (PRIOR ART)
FIG. 6A is a perspective view showing an electrode part of the conventional 4 rod electrode type RFQ linac.
Figure 6B:
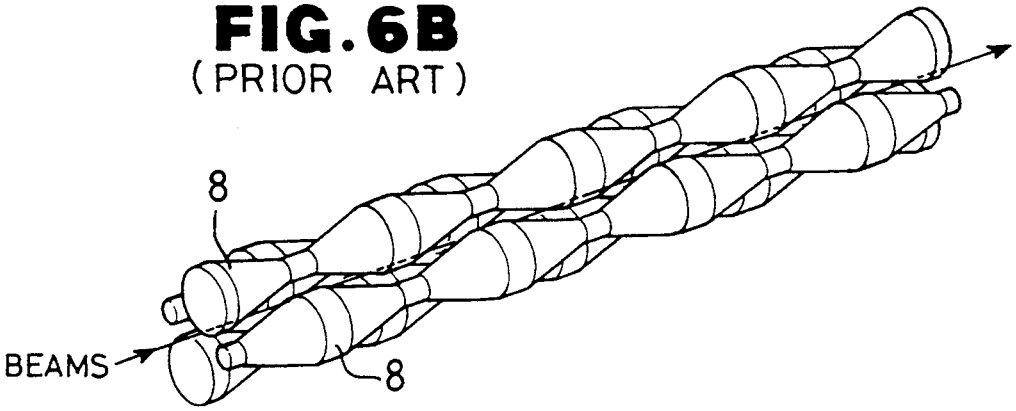
FIG. 6B (PRIOR ART)
FIG. 6B is a perspective view showing in detail the rod electrodes in FIG. 6A.
Figure 7A:
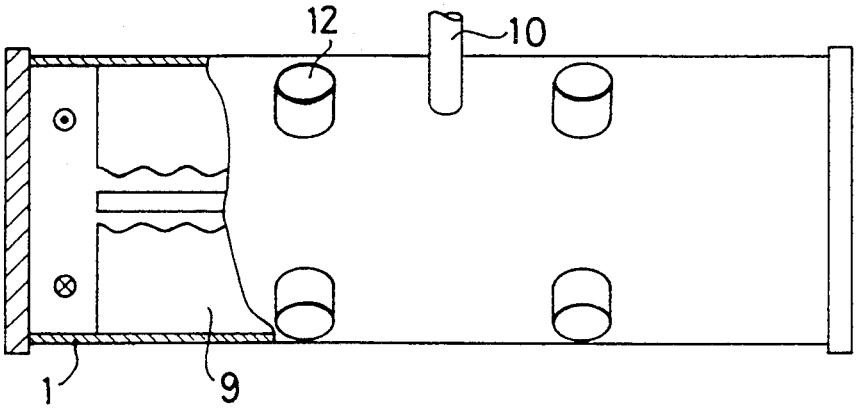
FIG. 7A (PRIOR ART)
FIG. 7A is a partially cut front view of a conventional 4 vane type RFQ linac.
Figure 7B:
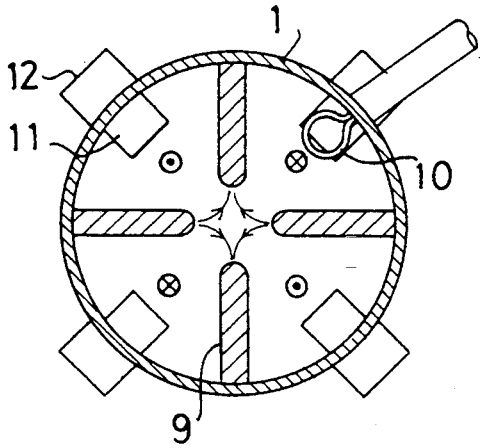
FIG. 7B (PRIOR ART)
FIG. 7B is a cross-sectional view of the conventional 4 vane type RFQ linac.
Figure 8:
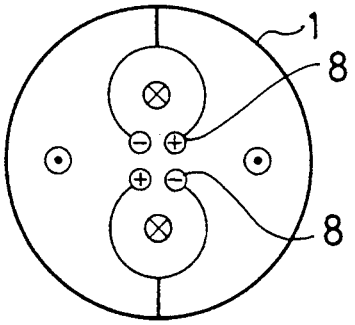
FIG. 8 (PRIOR ART)
FIG. 8 is a cross-sectional view showing a conventional double H type RFQ linac.
Figure 9A:
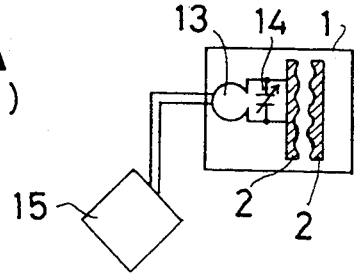
FIG.9A (PRIOR ART)
FIG. 9A is a diagram generally showing a conventional variable energy RFQ linac by means of variable frequency.
Figure 9B:
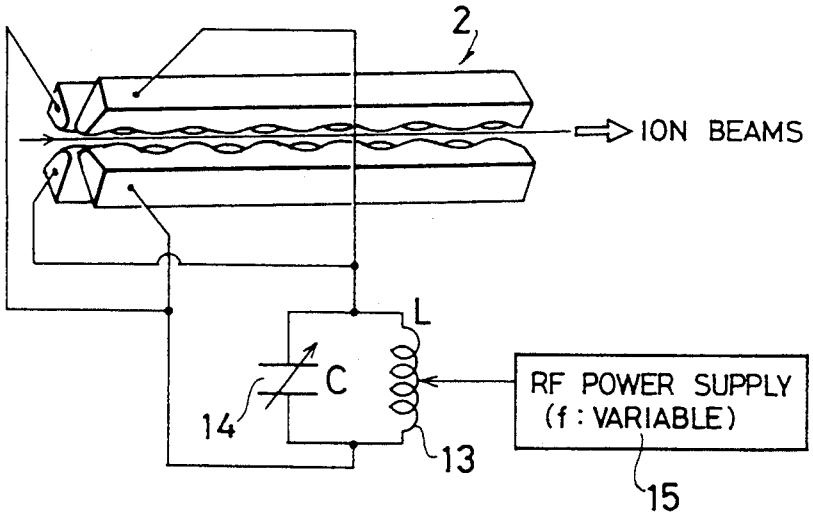
FIG.9B (PRIOR ART)
FIG. 9B is an equivalent circuit diagram of the variable energy RFQ linac shown in FIG. 9A.

By contrast, according to the present embodiment 1, when the electrode is divided into two at the position illustrated by a dash line in FIG. 13, and when only the electrode voltage in the downstream accelerating cavity 32 is changed, namely, when the radio frequency power level in the downstream accelerating cavity 32 is made to be lower than the radio frequency power level in the upstream accelerating cavity 31, the energy distribution of the output beams is as shown in FIG. 15. In this case, although the energy spread is slightly expanded depending on the value Vn, since all energy bands have sharp peaks of the number of particles, it will be seen that the energy can be lowered without largely lower the beam strength with respect to an arbitral energy width. Here, for the upstream electrode, the calculation is performed under the condition of $V_n=1$. FIG. 6 shows the energy change along the beam axis be easily understandable.

In this embodiment 1, since the synchronizing phase $\phi_s$ in the downstream electrode is constant, the electrode voltages when the separatrics is disappeared are almost the same for all cells in the downstream electrodes, resulting in that the efficient electrode parameters can be easily determined.

Embodiment 2.

Note that, in the above-mentioned embodiment 1, as shown in FIG. 13, the downstream accelerating cavity 32 (downstream electrode) is shorter than the upstream accelerating cavity 31 (upstream electrode), however, both lengths may be designed to be nearly the same. When so made, the power losses in the both of the accelerating cavities 31 and 32 can be made to be nearly the same so that it is sufficient to provide the two radio frequency power amplifiers 35 with the same specification, resulting in an advantage in that the cost can be reduced. In practice, the parameters shown in FIG. 13, for example, may be changed to make the lengths of the upstream accelerating cavity 31 and the downstream accelerating cavity 32 to be nearly the same. In this case, the emitting energy is naturally increased, however, as long as the length of the extended part of the downstream accelerating cavity 32 is shorter than about one period of the phase vibration, the similar effect as in the embodiment 1 can be obtained. In this case, however, there is a disadvantage in that there is a limitation in setting the electrode parameters. For example, the limitation is that the emitting energy can not be arbitrarily selected. When the emitting energy is fixed, the optimization of the parameters along the beam axis becomes uneasy.

This embodiment 2 corresponds to the second aspect of the present invention.

Embodiment 3.

In the above-described embodiment 1 also, the synchronizing phase $\phi_s$ in the downstream accelerating cavity 32 is illustrated to be constant, however, when the beam existing area with respect to the separatrics is reduced to a certain amount at the time of $\phi_s = -25$ degrees for example, the similar effect as in the embodiment 1 can be obtained by making the downstream accelerating cavity 32 after that point and by gradually changing $\phi_s$ to the final value in the downstream accelerating cavity 32. When $V_n$ is changed during a bunching process in which the separatics and the beams existing area are nearly the same, the energy spread is expanded in the similar way as in the conventional example.

Embodiment 4.

In the above-described embodiment 1 also, the split coaxial RFQ linac is employed, however, a similar effect as in the above embodiment can be obtained by employing an RFQ linac of the other type such as the 4 rod electrode type, the angular electrode type, the double H type, and so forth.

Embodiment 5.

Figure 17:
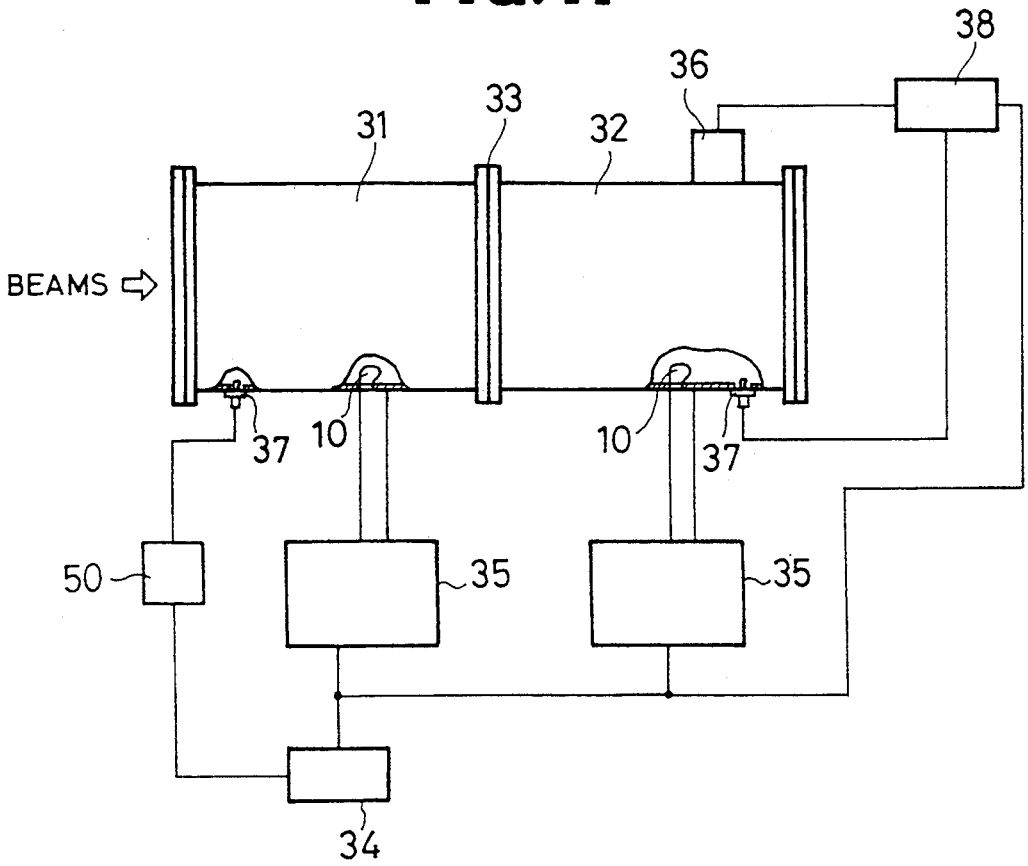
FIG. 17 is a constructional diagram showing a variable energy RFQ linac according to an embodiment 5 of the present invention.

Next, the embodiment 5 of the present invention will be described with reference to the drawings. FIG. 17 is a construction diagram showing a variable energy RFQ linac according to an embodiment of the fourth aspect of the present invention, in which the accelerating cavity has the same structure as that in the embodiment 1. The difference from the embodiment 1 is that the radio frequency system in one of the accelerating cavities 31 and 32, and in this case the upstream accelerating cavity 31 is a self-oscillated system. In FIG. 17, 50 is a phase adjusting unit (radio frequency system) for spontaneously oscillating the upstream accelerating cavity 31 with its resonant frequency, by forming a closed loop by changing the phase of the radio frequency detected by a monitor loop 37 to feed back it to the signal generator 34. Note that the other parts are the same as those denoted by the same symbols in the embodiment 1, and the explanation thereof are omitted.

Next, the operation will be described. The structure of the accelerating cavities 31 and 32 are generally changed depending on the change of the temperature so that the resonant frequency is changed. Since the Q value of the accelerating cavities 31 and 32 of the cavity resonance type is high, if the frequency of the input radio frequency power does not coincide with the resonant frequency, the input impedance is largely changed so that the radio frequency cannot be inputted. Therefore, as shown in the embodiment 1, the frequency tuners 36 are generally provided to correct the fluctuation of the resonant frequency to keep the resonant frequency to be constant. In this case, the frequency of the signal from the signal generator 34 is fixed. Such a system is referred to as a separately oscillated system.

By contrast, as shown in FIG. 17, the radio frequency power in the upstream accelerating cavity 31 is detected by the monitor loop 37, and the phase of the radio frequency power is appropriately changed by the phase adjusting unit 50 and is fed back to the signal generator 34 to form the closed loop, thereby the upstream accelerating cavity 31 is oscillated to be driven by its resonant frequency. In this case, the signal generator 34 does not have a role as a signal generator but merely has a role as a pre-amplifier. This is equivalent to the principle of a self-oscillator in the electronic circuit engineering which is spontaneously oscillated by appropriately changing the phase of the output of the amplifier and by returning it to the input side. Such a radio frequency system is a self oscillating system. Accordingly, in the self oscillation, when the resonant frequency of the upstream accelerating cavity 31 is changed due to a change of a temperature and so forth, the operating frequency is also changed.

On the other hand, the radio frequency system in the downstream accelerating cavity 32 is made to be a separate oscillation system similar to the case of the embodiment 1, so as to be driven by the frequency determined by the resonant frequency of the upstream accelerating cavity 31 in the self oscillation. Here, when the operating frequency is changed, the beam energy is also changed. The change of the energy due to a change of the temperature and so forth, however, is negligibly small so that there is no problem when the apparatus is used solely as an ion implantation apparatus, because the accelerating cavities 31 and 32 are generally cooled.

By making to be such a self oscillation, the frequency tuner 36 and the tuner control unit 38 are not necessary in the upstream accelerating cavity 31 so that not only the cost can be lowered but also the control of the operation can be simplified.

Here, if the similar radio frequency system is provided in the downstream accelerating cavity 32 to make it as a self oscillation, the frequency tuner 36 will not be necessary. In this case, however, the RFQ linac will be operated by two frequencies so that the phase difference between the two accelerating cavities 31 and 32 will be changed in time, resulting in large beam loss. Therefore, the downstream accelerating cavity 32 is made to be the separate oscillation operated with the frequency determined by the upstream accelerating cavity 31.

Note that, by making the upstream accelerating cavity 31 to be a separate oscillation, and by making the downstream accelerating oscillation 32 to be a self oscillation, the similar effect can be obtained. In the above-described embodiment, the upstream accelerating cavity 31 is not provided with the frequency tuner 36, however, when there is a possibility in that the resonant frequency is largely deviated from a design value due to a fabrication error and so forth, the frequency tuner 36 is mounted to adjust the resonant frequency. In this case, since the adjustment may be generally one time immediately after the fabrication, the frequency tuner 36 may be a fixed type and a low cost one, or even if it is a movable type, it may be very simple.

Embodiment 6.

Figure 18A:
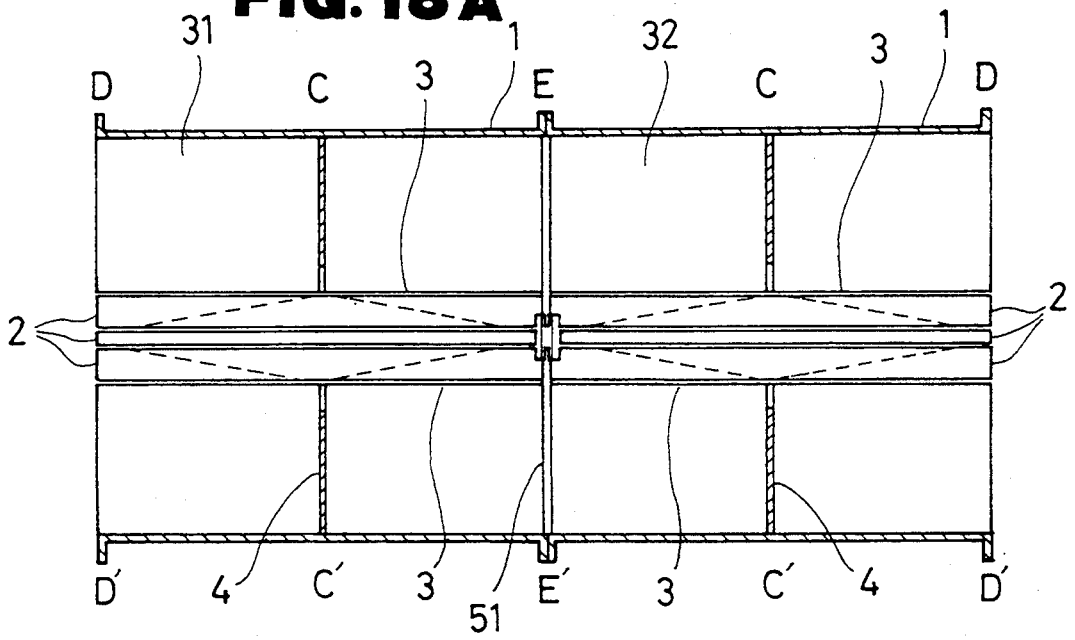
FIG. 18A is a cross-sectional view showing a variable energy RFQ linac in the beam axis direction according to an embodiment 6 of the present invention.
Figure 18B:
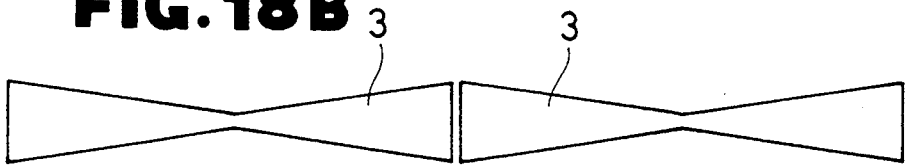
FIG. 18B is a top-plan view showing the back plate in FIG. 18A.
Figure 18C:
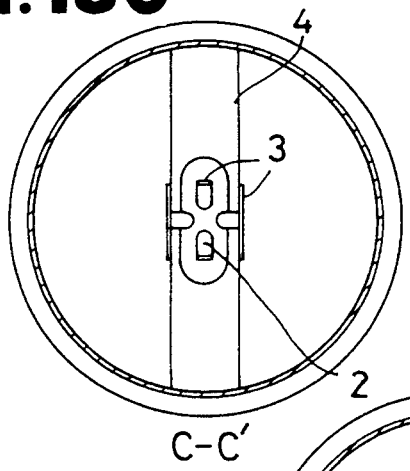
FIG. 18C, FIG. 18D, and FIG. 18E are cross-sectional views along C–C′, D–D′, and E–E′ in FIG. 18A.
Figure 18D:
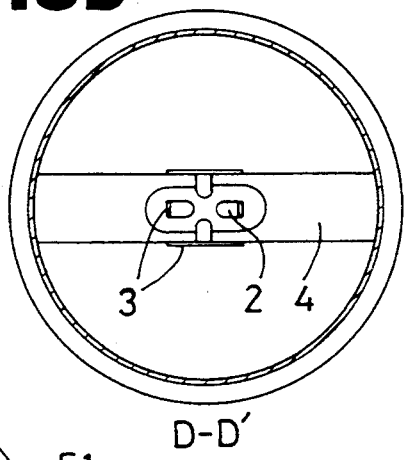
Figure 18E:
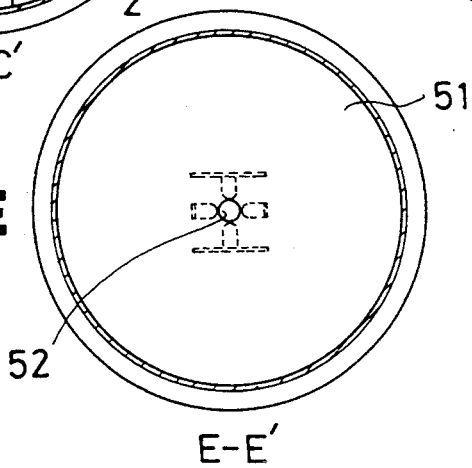

Next, an embodiment 6 of the present invention will be described with reference to the drawings. FIG. 18A is a cross section along the beam axis of the accelerating cavities 31 and 32 of a variable energy RFQ linac according to an embodiment of the fifth aspect of the present invention, in which a split coaxial type is shown as an example. FIG. 18B is a side view showing he back plate 3 in FIG. 18A. FIGS. 18C to 18E are cross sectional views in the direction rectangular to the beam axis, in which FIG. 18C is a C–C′ cross sectional view, FIG. 18D is a D–D′ cross sectional view, and FIG. 18E is an E–E′ cross sectional view. In the figures, reference numeral 51 is a separating plate that is provided to cover the whole of the cross section of the accelerating cavities for separating in the sense of radio frequency the upstream accelerating cavity 31 and the downstream accelerating cavity 32, and 52 is a beam passing window that is opened at the central portion of the separating plate 51 for passing the charged beams. Note that reference numerals 1–4 are same as those in the conventional parts denoted by the same symbols, and therefore, the explanation thereof is omitted.

Next, the operation will be described. The structural principle of the split coaxial accelerating cavity is the same as that described in the conventional example. The difference from the conventional example is that the separating plate 51 is provided around the central portion of the cylindrical cavity 1, and the waving electrodes 2 are also separated at that point. The separating plate 51 has, as shown in FIG. 18E, a disk-shaped form to cover the cross section of the cylindrical cavity 1, and has at its central portion the beam passing window 52. The separating plate 52 is in contact with the side wall of the cylindrical cavity 1. When the contacting portion is made of, for example, radio frequency conductor and so forth, it is more efficient because the radio frequency resistance can be made to be further small.

The upstream waving electrode 2 and the downstream waving electrode 2 are in contact with the separating plate 51 as shown in FIG. 18A. Therefore, the upstream waving electrode 2 and the downstream waving electrode 2 are separated by the separating plate 51 perpendicular to the beam axis. Accordingly, the separating plate 51 performs, as an equivalence, a role similar to that of the stems 4 shown in FIGS. 18C and 18D. The separating plate 51, however, covers the whole surface of the cross section of the cylindrical cavity 1 except for the beam passing window 52 so that the magnetic coupling between the upstream accelerating cavity 31 and the down stream accelerating cavity 32 is extremely weak. In addition, singe the beam passing window 52 is so small that the separated waving electrodes 2 cannot be seen from each other. Therefore, the capacitive coupling between the separated waving electrodes 2 is also very weak. As a result, even when a radio frequency power is inputted into only the upstream accelerating cavity 31 for example, it is not transmitted to the downstream accelerating cavity 32. Accordingly, the radio frequency power levels in the upstream accelerating cavity 31 and the downstream accelerating cavity 32 can be changed independently to each other.

Figure 19:
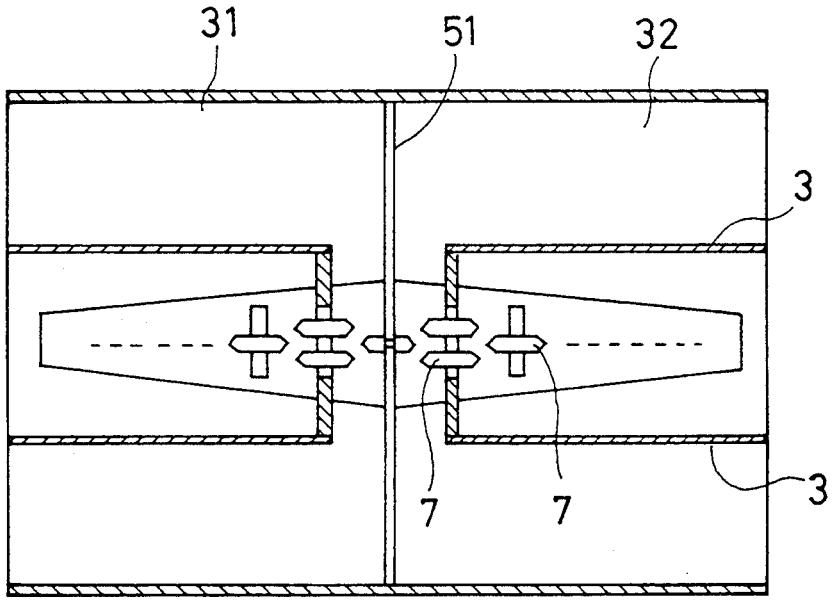
FIG. 19 is a cross-sectional view showing a variable energy RFQ linac according to an embodiment 6 of the present invention.
Figure 20:
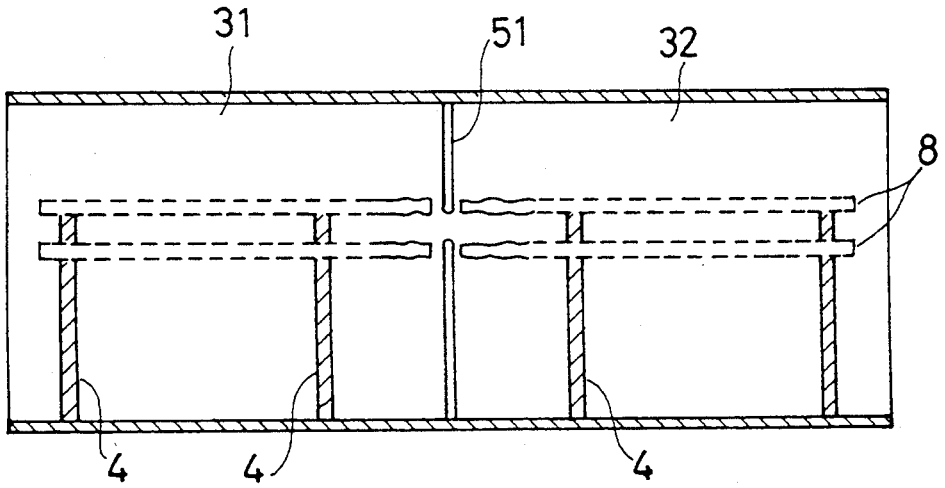
FIG. 20 is a cross-sectional view showing a variable energy and 4 rod electrode type RFQ linac according to an embodiment 6 of the present invention.
Figure 21B:
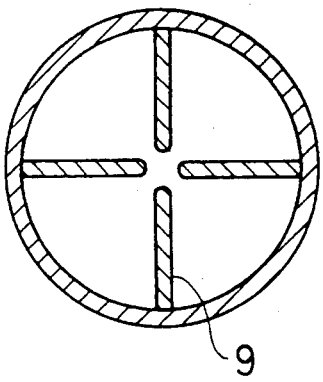
FIG. 21A and FIG. 21B are cross-sectional views showing a variable energy and 4 vane type RFQ linac according to an embodiment 6 of the present invention.
Figure 21A:
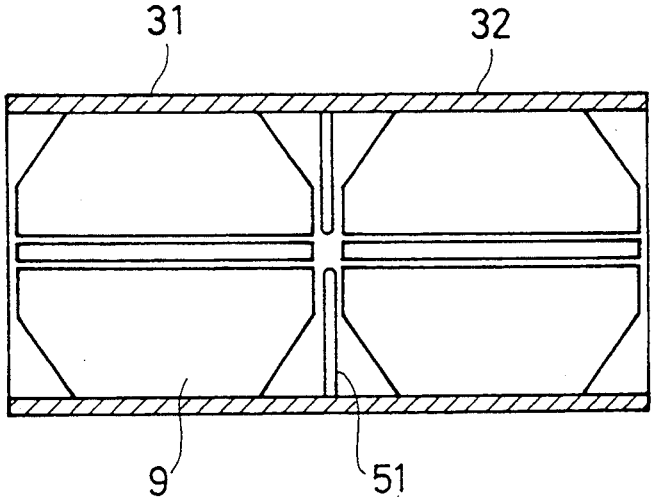
Figure 22B:
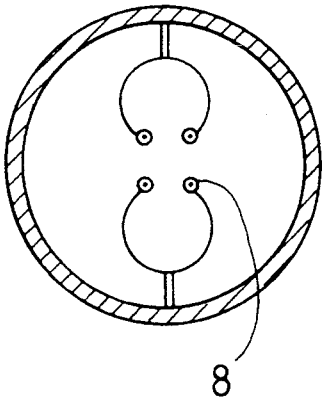
FIG. 22A and FIG. 22B are cross-sectional views showing a variable energy and double H type RFQ linac according to an embodiment 6 of the present invention.
Figure 22A:
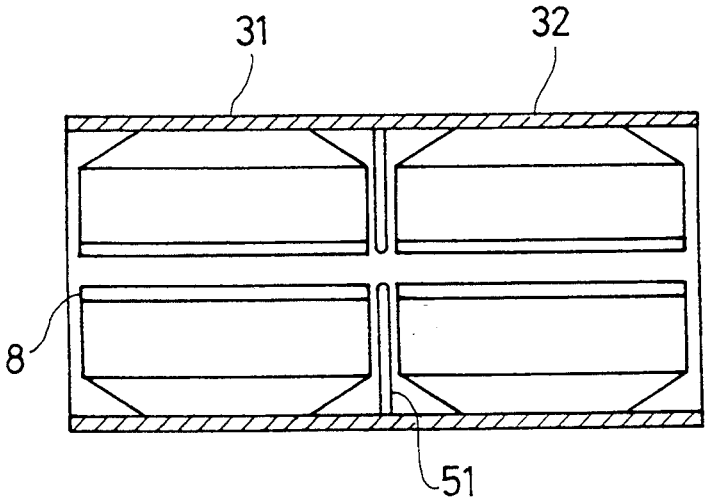

In the above-described embodiment, the waving electrodes 2 are employed, however, the similar effects can be obtained by applying this embodiment to the angular type electrodes, to the 4 rod electrodes, to the 4 vane type, to the double H type and so forth shown in the conventional examples. The respective general cross sectional view are shown in FIG. 19 to FIG. 23. FIG. 19 is a cross sectional view when this embodiment is applied to the angular electrode type RFQ linac, FIG. 20 is a cross sectional view when this embodiment is applied to the 4 rod electrode type RFQ linac, FIGS. 21A and 21B are cross sectional views when this embodiment is applied to the 4 vane type RFQ linac, and FIGS. 22A and 22B are cross sectional views when this embodiment is applied to the double H type RFQ linac. In the 4 rod electrode type RFQ linac in FIG. 20, the separating plate 51 is placed in the intermediate position between two stems 4.

Figure 23:
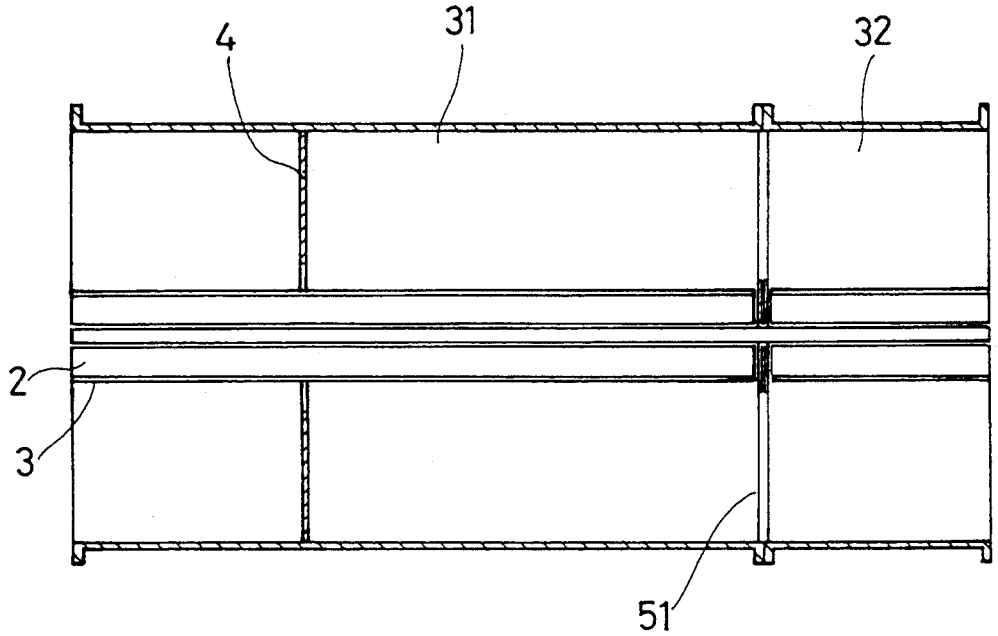
FIG. 23 is a cross-sectional view showing a variable energy and split coaxial RFQ linac according to an embodiment 6 of the present invention.

In the above-described embodiments illustrated in FIGS. 18A to 22B, the separating plate 51 is provided at a position for nearly equally dividing the accelerating cavity, however, it is not always necessary to nearly equally divide it. FIG. 23 is a cross sectional view of such a case showing a split coaxial RFQ linac similar to FIG. 18A. In the illustrated example, the division is effected in such a way that the upstream accelerating cavity 31 is sufficiently larger than the downstream accelerating cavity 32, amid the separating plate 51 is provided between the upstream accelerating cavity 31 and the downstream accelerating cavity 32.

Embodiment 7.

In the above-described embodiment 6, the opposing two pairs of the waving electrodes 2 are cut by a plane substantially perpendicular to the beam direction, and the separating plate 51 is inserted between them, however, it is also possible to make the beam passing window 52 in the separating plate 51 to be a long hole, and to make one of the two pairs of the waving electrodes 2 to be inserted into the beam passing window 52 of the long hole without cutting it. The waving electrodes 2 inserted into the beam passing window 52 of the long hole are so inserted to be in contact with the separating plate 51. Thus, it becomes possible to fabricate one of the waving electrodes 2 as one body without separating at the dividing position, so that the waving electrodes 2 can be fixed more stiff.

Embodiment 8.

Figure 24:
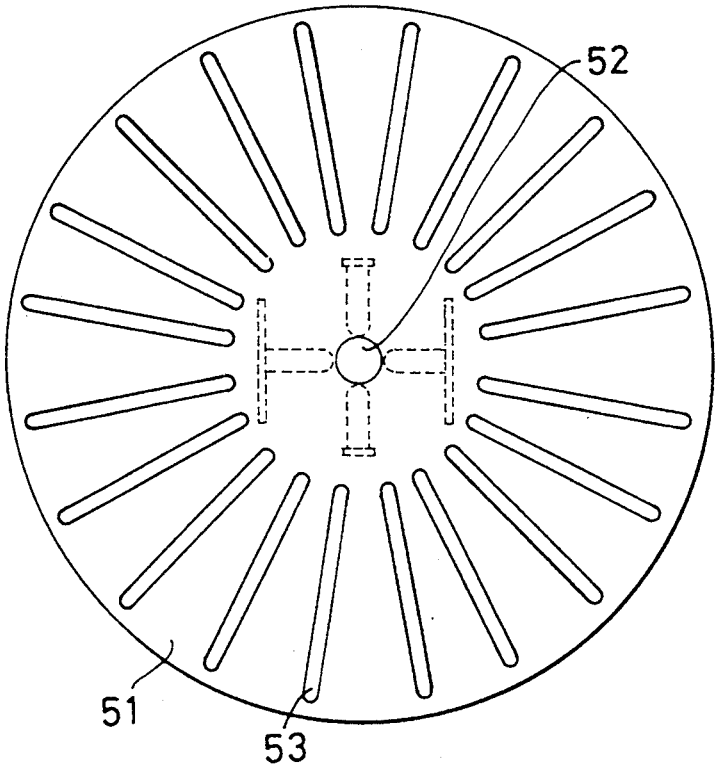
FIG. 24 is a front view showing a separating plate used in a variable energy RFQ linac according to an embodiment 8 of the present invention.
Figure 25:
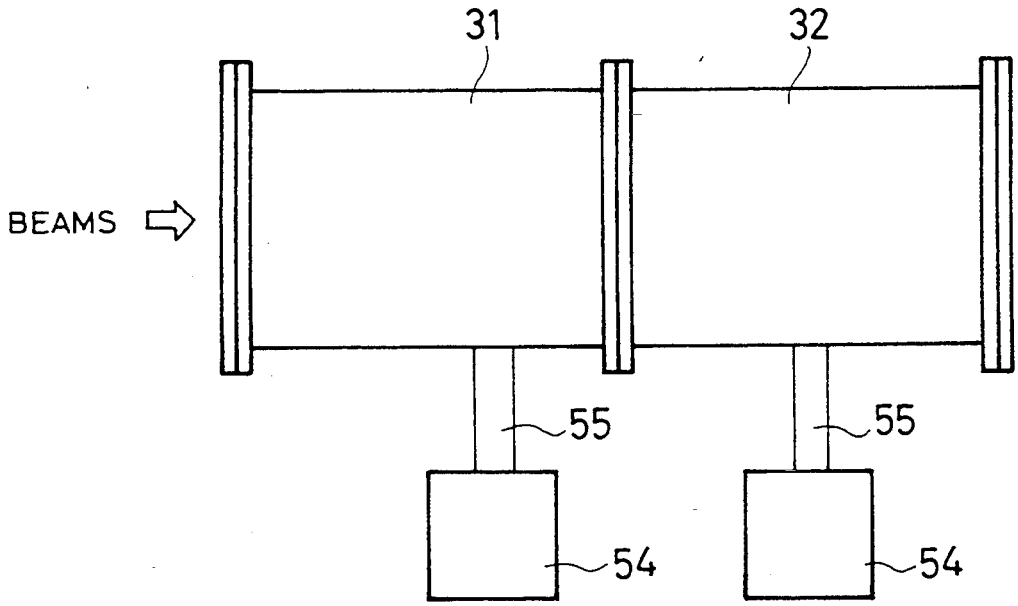
FIG. 25 is a general constructional diagram showing a vacuum exhaust system for explaining an exhaust in the accelerating cavity in the embodiment 8 of the present invention.

In the above-described embodiment 6 also, an explanation has been given for the case in which only the beam passing window 52 is opened at the central portion of the separating plate 51, however, by opening a number of holes through which the radio frequency power cannot be passed, the upstream accelerating cavity 31 and the downstream side accelerating cavity 32 are made to be a one body in the sense of vacuum, so that the exhaustion for vacuum may be effected in either one, resulting in a reduction of the cost. FIG. 24 is a front view showing an example of such a separating plate 51. In the figure, 53 is long holes, through which the radio frequency power cannot be passed, radially opened in the separating plate 51. FIG. 25 is a diagram showing an outline of the vacuum exhaust system for the case of the above embodiment 6. In the figure, 54 is vacuum exhaust units, and 55 is vacuum exhaust ducts for connecting the vacuum exhaust units 54 with the upstream accelerating cavity 31 or with the down stream accelerating cavity 32.

This embodiment 8 corresponds to the sixth aspect of the present invention.

In the separating plate 51 shown in the embodiment 6, only the beam passing window 52 is opened at its central portion so that the vacuum exhaust must be separately effected in the upstream accelerating cavity 31 and the downstream accelerating cavity 32 as shown in FIG. 25. When a number of the long holes 53 through which the radio frequency cannot be passed are opened in the separating plate 51 as shown in FIG. 24, the upstream accelerating cavity 31 and the downstream accelerating cavity 32 become a one body in the sense of vacuum. Therefore, it is sufficient to effect the vacuum exhaust in either one of the accelerating cavities 31 and 32 by the single vacuum exhaust unit 54, resulting in that the cost for the one system of the vacuum exhaust unit 54 and the vacuum exhaust duct 55 can be reduced. Here, when holes are opened in the separating plate 51, the radio frequency resistance is increased so that the power loss in the separating plate 51 is increased, however, as shown in FIG. 24, by radially open the long holes 53, the radio frequency resistance can be made small. This is because, since the radio frequency current conducts from the electrode contact portion to the side wall of the cylindrical cavity 1 (note that the current direction alternates in time because of the alternating current), the radio frequency resistance can be reduced by opening the long holes each having a long axis in the direction of the current, resulting in the reduction of the power loss in the separating plate 51.

Embodiment 9.

Figure 26:
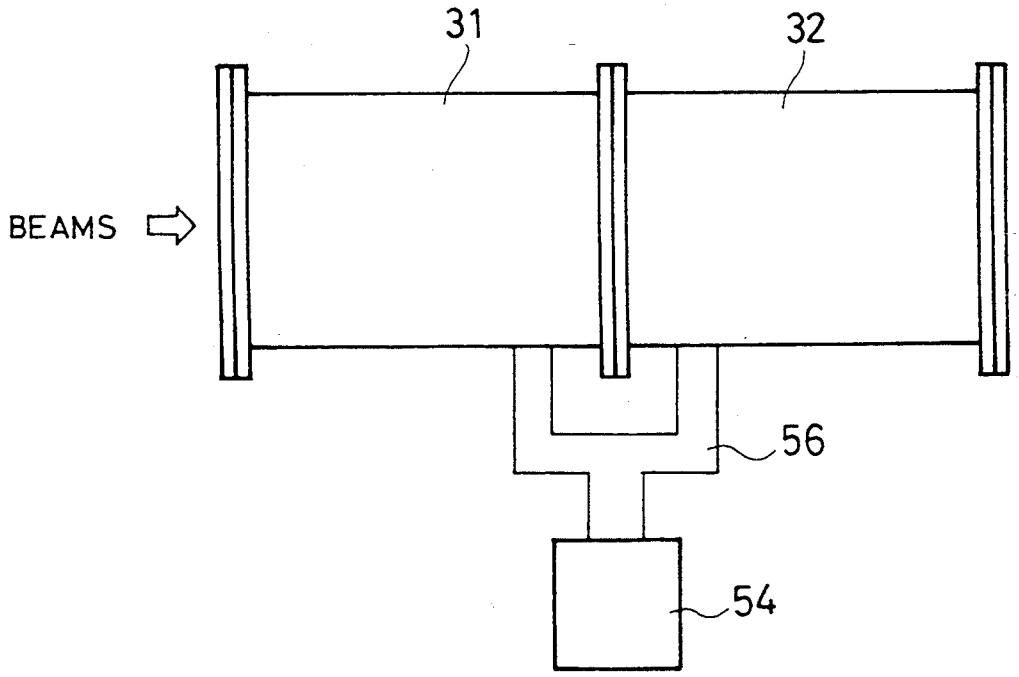
FIG. 26 is a general constructional diagram showing a vacuum exhaust system according to an embodiment 9 of the present invention.

In the above-described embodiment 8, to effect the vacuum exhaust of the upstream accelerating cavity 31 and the downstream vacuum cavity 32 by the single vacuum exhaust unit 54, the long holes 53 are opened in the separating plate 51, however, as shown in FIG. 26, by employing a vacuum branching duct 56 which branches off from the single vacuum exhaust unit 54 and is connected to the upstream accelerating cavity 31 and the downstream accelerating cavity 32, it is also possible to reduce the one system of the vacuum exhaust unit 54 and the vacuum exhaust duct 55 without opening holes other than the beam passing window 52. By this arrangement, the increase of the radio frequency resistance due to the holes opened by the separating plate 51 can be prevented so that the power loss in the separating plate 51 can be reduced to the minimum. In this case, the vacuum branching duct 56 is naturally long so that it is effective to use the one having a large diameter.

This embodiment 9 corresponds to the seventh aspect of the present invention.

Embodiment 10.

Figure 27:
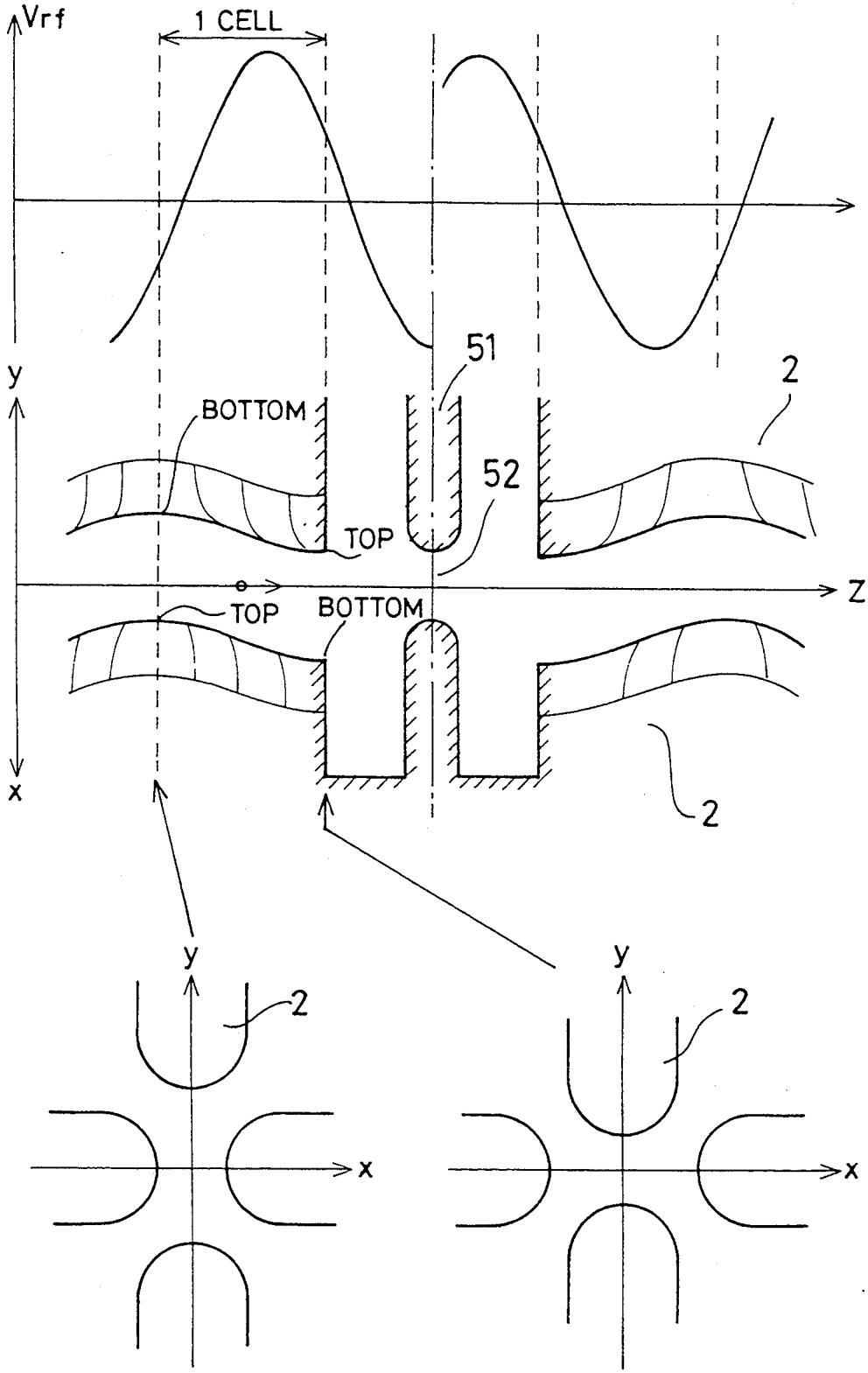
FIG. 27 is an explanatory diagram showing the proximity of the position where the electrodes are separated along with the change of the radio frequency phase in the embodiment 6 of the present invention.

In each of the above-described embodiments, the distance between the separated waving electrodes 2 is not specifically determined, however, when the distance between the separated electrodes is selected to be equal to two cells, it is not necessary to change the phase difference between the upstream accelerating cavity 31 and the downstream accelerating cavity 32. FIG. 27 is an explanatory diagram showing a cross section around the separating portion of the electrodes in the beam axis direction when the distance between the separated electrodes is arbitrary selected, the change of the radio frequency phase when a charged particle advances along the beam axis, and the cross sections of two planes (x,y) of the waving electrodes 2 vertical to the beam axis, together.

The waving electrodes 2 are so designed that, when a charged particle advances a half period of the wave, namely, between the bottom and the top of a waving electrode 2, the radio frequency phase is changed by $\pi$. The half period of the waving electrode is called as one cell. Since the beam axis components (z components) of the electric fields produced by the waving (modulation) of the electrodes are opposite in the adjacent cells, there is a condition for a charged particle to be accelerated in all of the cells by the change of the radio frequency phase by $\pi$. Therefore, the radio frequency phase of the charged particle when it is outputted from the upstream electrode (upstream accelerating cavity 31) must coincide with the radio frequency phase when it is inputted into the downstream electrode (downstream accelerating cavity 32).

Figure 28:
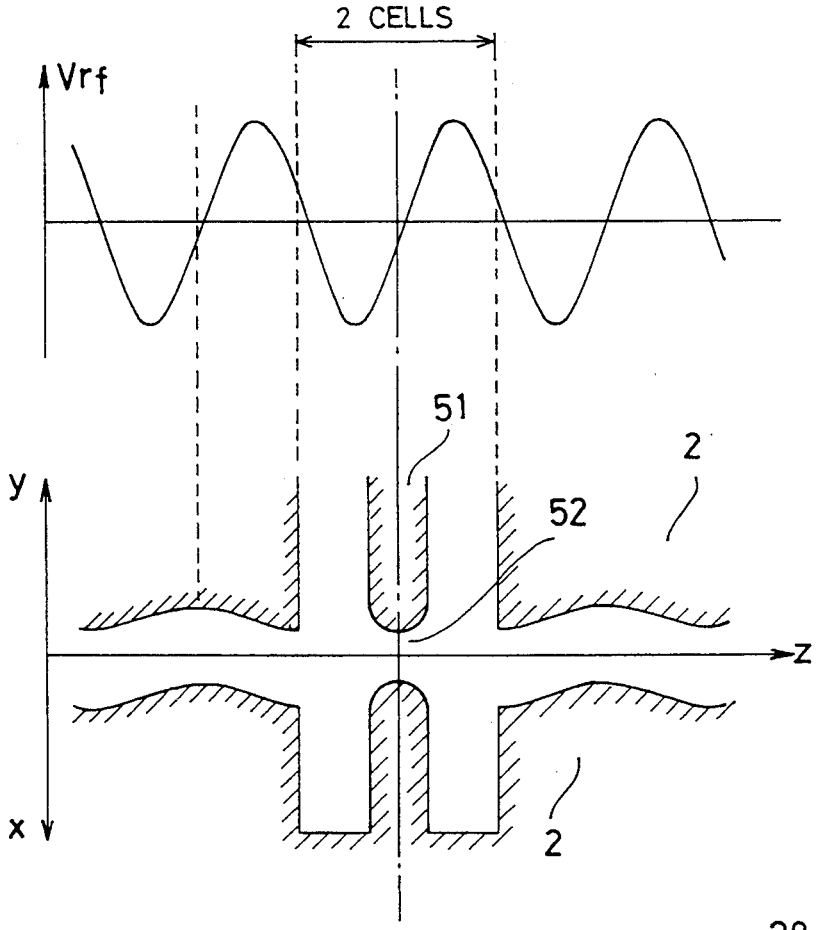
FIG. 28 is an explanatory diagram showing the proximity of the position where the electrodes are separated along with the change of the radio frequency phase in the embodiment 10 of the present invention.

In the example shown in FIG. 27, because the distance between the separated electrodes is selected to be an arbitral value, the phases of the upstream accelerating cavity 31 and the downstream accelerating cavity 32 must be changed by any means. By contrast, when the distance between the separated electrodes is selected to be that of two cells as shown in FIG. 28, it is not necessary to change the phase difference between the upstream accelerating cavity 31 and the downstream accelerating cavity 32 so that the adjustment of the radio frequency phase is not necessary, resulting in that the radio frequency system is simplified, the cost is reduced, and the beam adjustment becomes easy. Note that, to obtain the same effect, the distance between the separated electrodes is not limited to that of two cells, but may be even times of one cell.

Embodiment 11.

Figure 29:
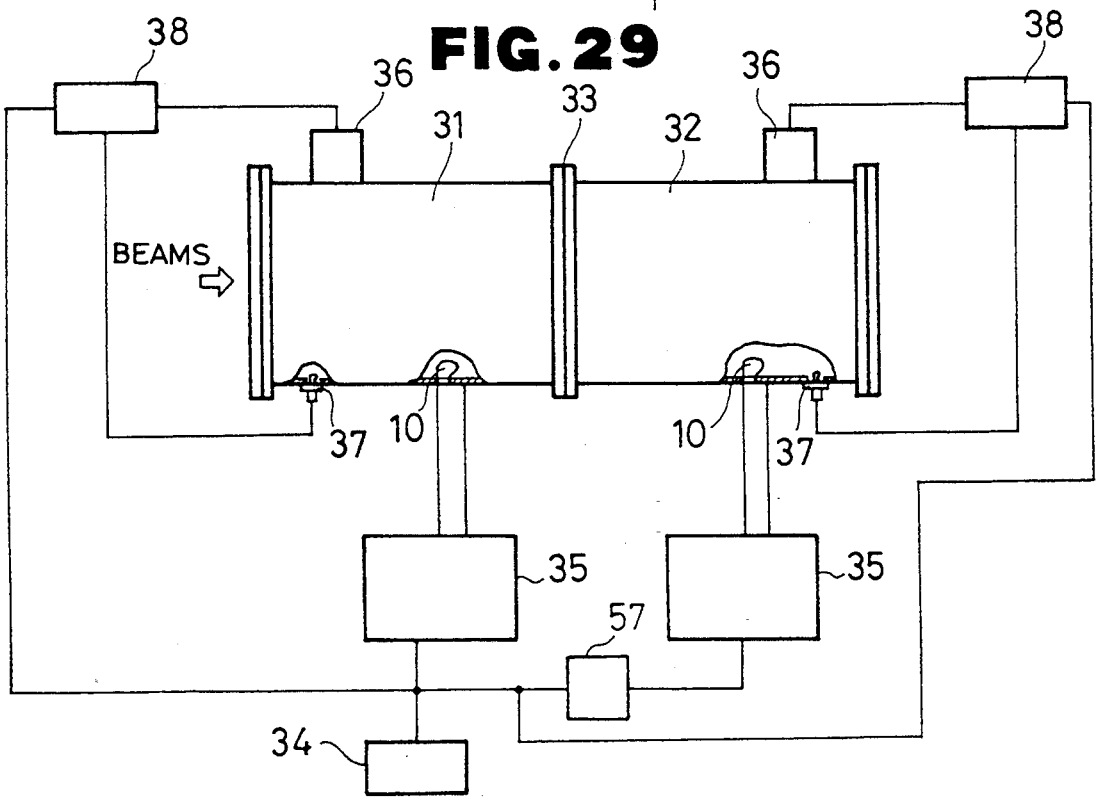
FIG. 29 is a constructional diagram showing a variable energy RFQ linac according to an embodiment 11 of the present invention.

Next, an embodiment 11 of the present invention will be described with reference to the drawings. FIG. 29 is a constructional diagram snowing a variable energy RFQ linac according to an embodiment of the ninth aspect of the present invention. The embodiment 11 differs from the embodiment 1 in that the radio frequency signal from the signal generator 34 is supplied to the radio frequency amplifier 35 through a phase adjusting means. In the figure, 57 is a phase adjusting unit which is the same as the one with the symbol 50 in FIG. 17 and is used as this phase adjusting means. The structure around the separating position of the electrodes 2 is the same as that shown in FIG. 28.

In the above-described embodiment 10, when the length of one cell of the waving electrode 2 is long, the distance between the separated electrodes is naturally long. In a RFQ linac, because the beam is generally focused by a strong focusing force, the radius of the beam is rapidly expanded once it leaves the electrode. Therefore, the longer the distance between the separated electrodes, the larger the number of charged beams becomes which collide with the downstream electrodes or the separating plate 51 to be lost. In particular, when the position of the separated waving electrodes 2 is in the region where the radius of an aperture through which a charged beam can pass is nearly equal to the beam radius, the loss is large.

To avoid this, it is preferable that the distance between the separating plate 51 and the electrode 2 is the minimum distance in which there is no discharge therebetween. On the other hand, however, as described in the embodiment 10, the radio frequency phase of the charged particle when it is outputted from the upstream electrode must nearly coincide with the radio frequency phase when it is inputted into the downstream electrode. Therefore, as shown in FIG. 29, a phase adjusting unit 57 is provided, between the signal generator 34 and the radio frequency amplifier 35 in the downstream accelerating cavity 32, which can largely change the phase, thereby the radio frequency phase in the upstream accelerating cavity 31 and in the lower stream side accelerating cavity 32 are relatively changed. Note that the phase adjusting unit 57 can change the electrical length between the signal generator 34 and the radio frequency amplifier 35, and the maximum change width may be $2\pi$. By this,the distance between the separated electrodes of the waving electrodes 2 can be arbitrarily selected.

Embodiment 12.

In each of the above-described embodiments, there is no specific description about the relation between the diameter of the hole of the beam passing window 52 in the separating plate 51 and the minimum diameter of a cell before or after the position where the electrodes are separated, however, by making them to nearly coincide to each other, the independence in the sense of radio frequency in the accelerating cavities 31 and 32 can be raised with the minimum beam loss Here, when the beam passing window 52 of the separating plate 51 is too large, the radio frequency coupling between the upstream accelerating cavity 31 and the downstream accelerating cavity 32 becomes large so that these cannot be controlled independently. When it is too small, a problem arises in that charged beams collide with the separating plate 51 to be lost. In case the waving electrodes 2 or the 4 rod electrodes 8 are employed, when the radius of the beam becomes larger than the radius of the beam aperture equal to the distance from the beam axis to the top of the electrode, namely, when the radius of the beam becomes larger than the minimum beam aperture throughout one cell, the beams begin to collide with the electrodes. Accordingly, by making the radius of the minimum beam aperture in the cell before or after the position where the electrodes are separated to be nearly equal to the radius of the beam passing window 52 of the separating plate 51, the beam passing window 52 can be made to be most efficient.

This embodiment 12 corresponds to the aspect 10 of the present invention.

Embodiment 13.

In each of the above-described embodiments, there is no specific limitation about the separating position of the waving electrodes 2, however, as shown in FIG. 18, when the waving electrodes 2 are separated at the top or the bottom of the wave, the electric field leaking into the separated space can be made minimum so that its influence on the beam can be made small. This is because, at this point, only the electric field component vertical to the beam axis is generated so that the leakage electric field is minimum when they are separated at this point.

This embodiment 13 corresponds to the eleventh aspect of the present invention.

Embodiment 14.

Figure 30A:
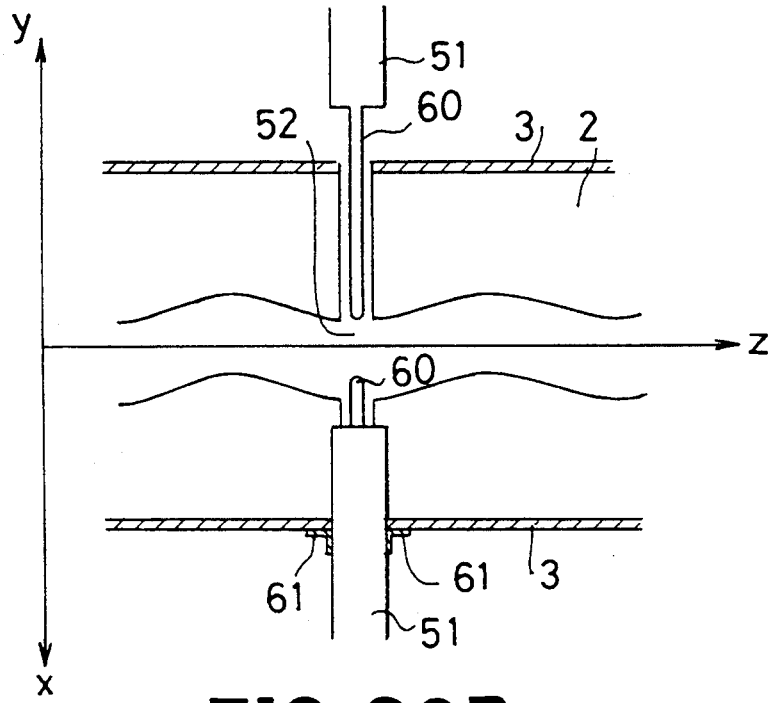
FIG. 30A and FIG. 30B are cross-sectional views showing the proximity of the electrode separating position in an embodiment 14 of the present invention.
Figure 30B:
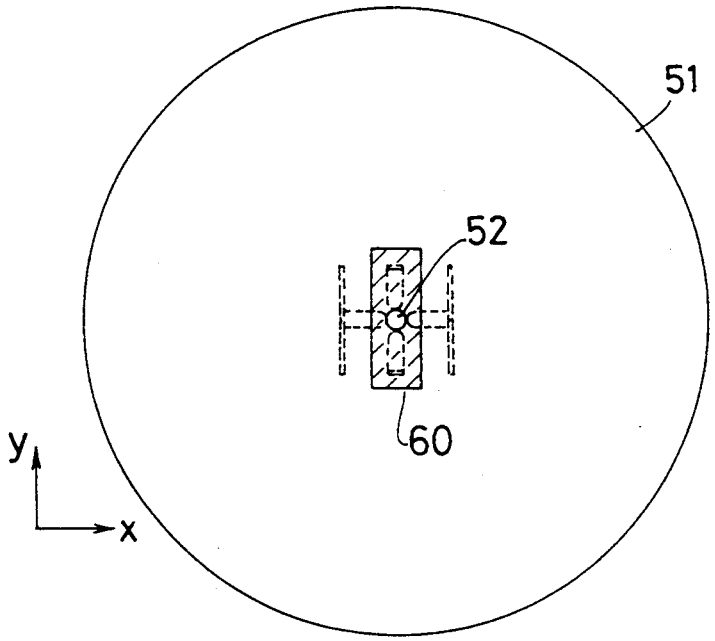

Next, an embodiment 14 of the present invention will be described with reference to the drawings. FIGS. 30A and 30B are cross sectional views showing a variable energy type RFQ linac according to the twelfth aspect of an embodiment of the present invention, wherein FIG. 30A shows cross sections of the waving electrodes 2 around the electrode separating point and in the beam axis direction. The cross sections in FIG. 30 A are planes (x,y) orthogonal to each other and including the beam axis. FIG. 30 B shows a cross section of a plane orthogonal to the beam axis. In the figure, 60 is a thin plate region in which the thickness of the separating plate 51 is made to be thin at a proximity of the electrodes in the central portion of the plate where the beam passing window 51 is opened. Also, 61 is L-shaped metal fittings, fixed by, for example, screws, for fixing the waving electrodes 2 and the back plate 3 to the separating plate 51. The other parts have already been described so that their explanations are omitted.

It is desirable, as explained in the embodiment 11, that the distance between the separated electrodes is as short as possible. In this embodiment 14. as illustrated in FIGS. 30A nd 30B, the method to make the distance between the separated electrodes to be shorter. The inner radiuses of the accelerating cavities 31 and 32 depend on the operating frequency, and are generally about 50 cm. Because the separating plate has a size similar to the inner radius of the accelerating cavities 31 and 32, if the plate is too thin, problems arise such that the fixing accuracy becomes bad or thermal distortion during an operation easily tends to be generated. In addition, generally, the accelerating cavities 31 and 32, the stems 4, and the waving electrodes 2 are cooled, and the separating plate 51 is also cooled in most cases. In this case, taking the cooling structure into consideration, the thicker the separating plate 51, the easier the fabrication of the separating plate is.

Figure 31A:
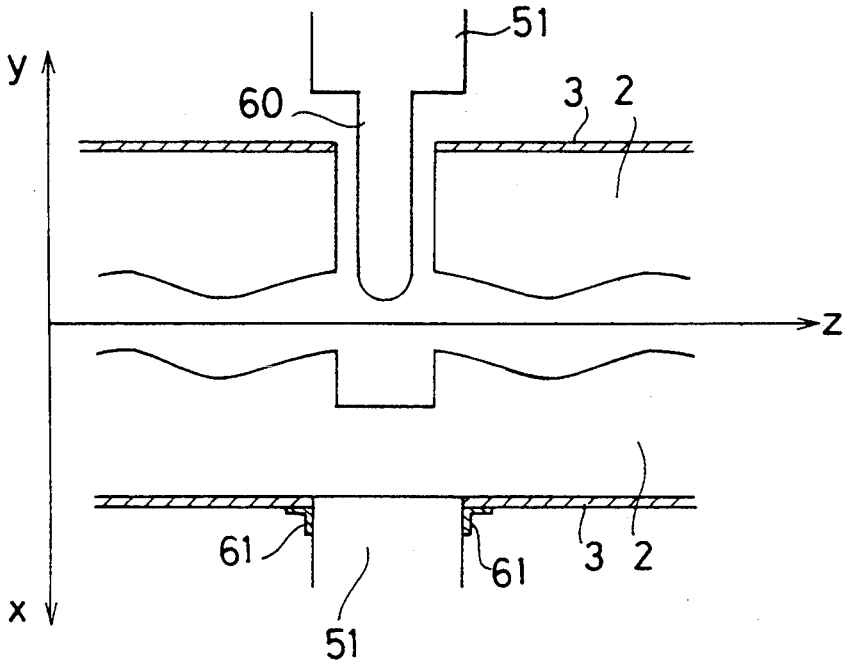
FIG. 31A and FIG. 31B are cross-sectional views showing the proximity of the electrode separating position in an embodiment 15 of the present invention.
Figure 31B:
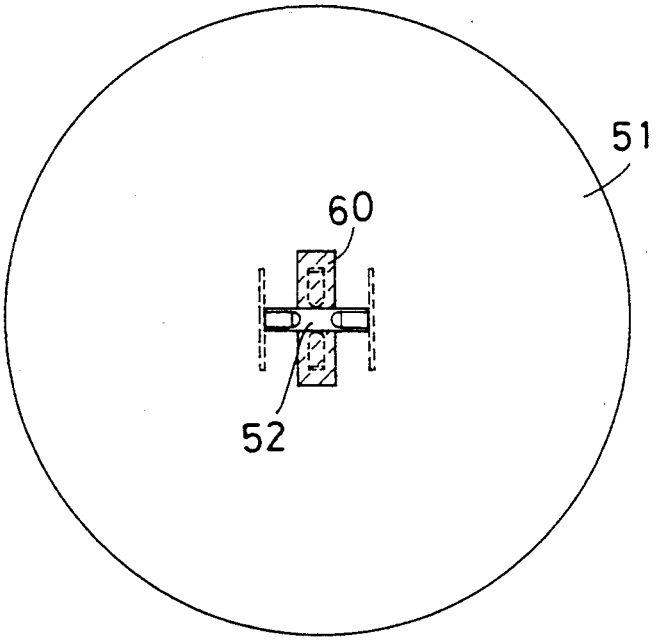

Accordingly, as shown in FIGS. 30A and 30B, by making only the portion around the central portion (the hatched portion in FIG. 31B) of the separating plate 51 opposite to the waving electrodes 2 to be thinner to form the thin plate region 60, there is no problem in strength, and the distance between the separated electrodes can be shortened. Note that a round portion of the thin plate region 60 faced to the beam passing window 52 is a countermeasure for discharge. Also, the reason why the thickness of the separating plate 51 is changed at the portion where the waving electrodes 2 contact with the separating plate 51 (in the x direction) is to reduce more the leakage electric field.

Embodiment 15.

Figure 32A:
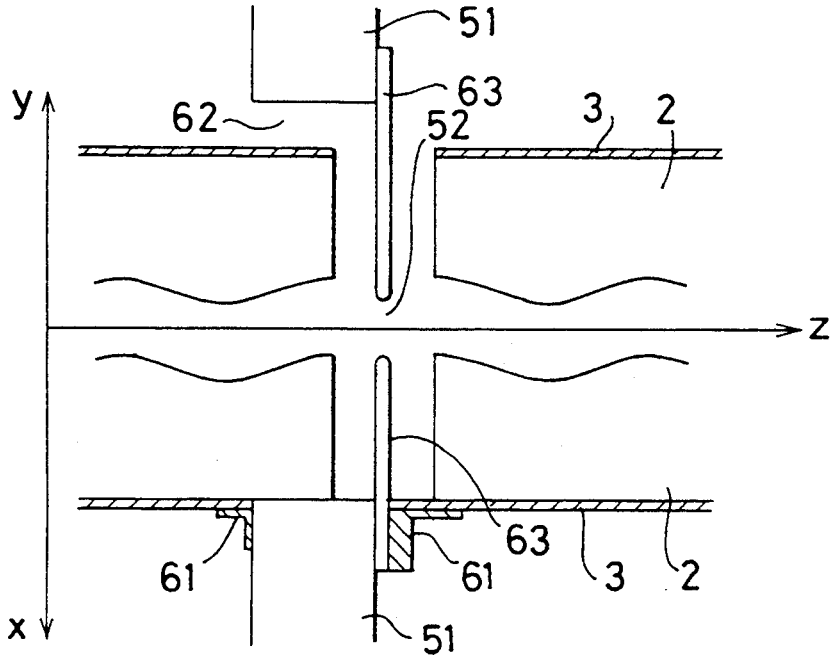
FIG. 32A and FIG. 32B are cross-sectional views showing the proximity of the electrode separating position in an embodiment 16 of the present invention.
Figure 32B:
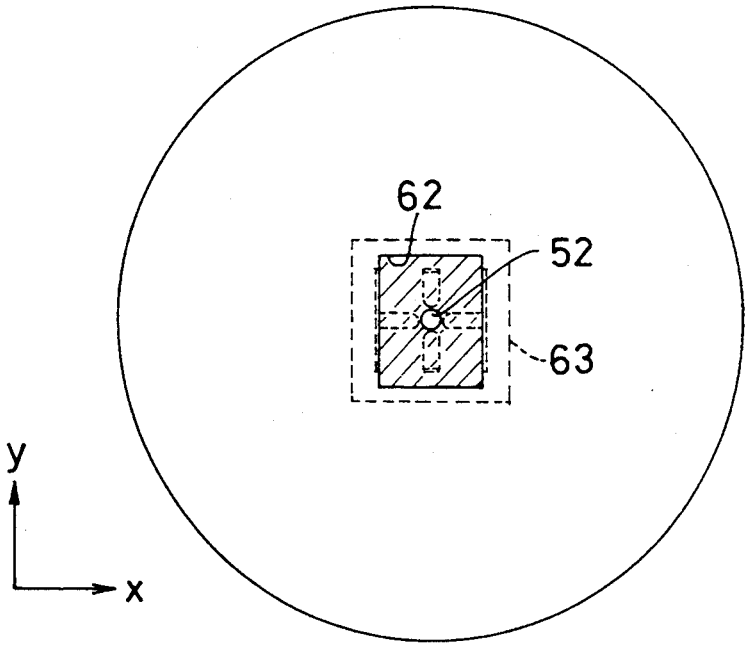

As explained in the embodiment 7, when the beam passing window 52 of the separating plate 51 is made to be a long hole, and when one of the pairs of the waving electrodes 2 is inserted into the long hole, as shown in FIGS. 32A and 32B, only the portion around the central portion (the hatched portion in FIG. 32B) of the separating plate 51 opposite to the separated waving electrodes 2 to be thin to form the thin plate region 60. In this structure, since the long hole is opened as the beam passing window 52 to insert the waving electrode 2 into the long hole, the electrode 2 in contact with the separating plate 51 is not cut but can be fabricated as one body. Therefore, the waving electrodes 2 can be fixed more tightly.

Embodiment 16.

Figure 33:
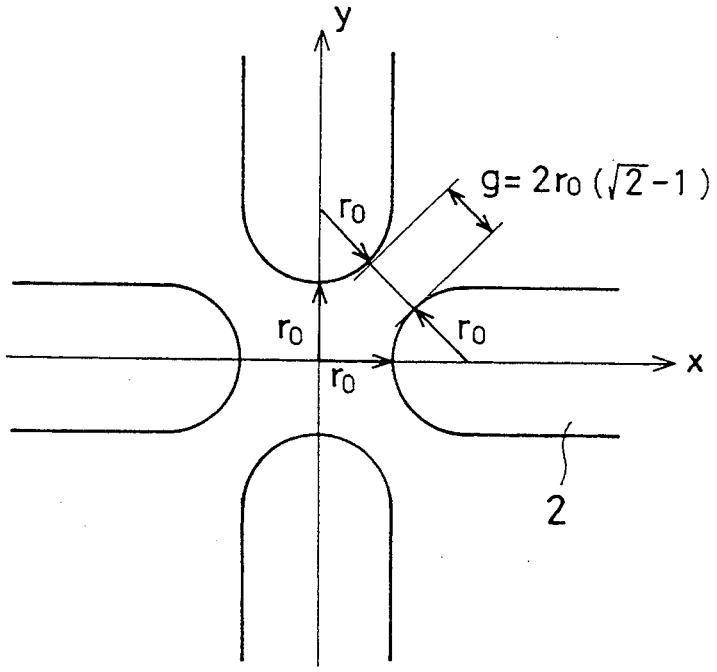
FIG. 33 is a cross-sectional view showing the proximity of the tops of the waving electrodes in an embodiment 17 of the present invention.

In the above-described embodiments 14 and 15, the thin plate region 60 and the separating plate 51 are formed as one body, however, as shown in FIGS. 32*a* and 32*b*, the thin plate region may be formed separately from the main body of the separating plate 51, and these may be assembled to obtain the similar effect as in the above-described embodiment 14. In FIG. 33, 62 is an opening portion of the separating plate largely opened at the central portion of the separating plate 51 and in the proximity of the electrodes, and 63 is separating thin plates (thin plate region) consisting of conductive plate material thinner than the separating plate 51 and provided with the beam passing window 52 at its central portion. By fixing the separating thin plate 63 to the opening portion of the separating plate 51 by means of screws and so forth, the thin plate region is realized.

Embodiment 17.

In each of the above-described embodiments, there is no specific description about the relation between the distance between the separating plate and the electrode and the closest distance between the adjacent electrodes, however, by making the former to be nearly equal to or larger than the latter, in a split coaxial RFQ linac, an apparatus with a small beam loss can be realized without a problem of a discharge limit.

Here, in the RFQ linac, to make the accelerating efficiency to be higher and to accelerate heavier ions by the same operating frequency, the intensity of the electric field must be higher as long as possible. Therefore, in such an RFQ linac, a discharge limit of electrodes is an important parameter. FIG. 33 is an expanded cross-sectional view of the portion around the tops of the electrodes. The four shapes of the cross sections of the electrodes are symmetric at the central portion of the cell (at the intermediate portion between the top and the bottom of the waving shape), and the radiuses $r_0$ of the curvatures are generally made to be equal to the distance from the beam axis to the top of the electrode. In this case, the distance between the adjacent electrodes is $g=0.827r_0$, which is the closest throughout one cell. Accordingly, the intensity of the electric field at the surface of each electrode is maximum. Considering them as parallel plates, the intensity of the electric field at the surface of each electrode is $E=1.207\ V_0/r_0$, where $V_0$ is the voltage between the electrodes. According to a two-dimensional numeric calculation for the constant cross sections shown in FIG. 34, the maximum intensity of the electric field is $E=1.36\ V_0/r_0$. In case of a three-dimensional calculation taking into account the waving, it is slightly larger than that depending on the parameter of the cell.

On the other hand, in the split coaxial RFQ linac, a pair of the electrodes are connected to the separating plate. Therefore, the potential difference between the other pair of the electrodes and the separating plate is $V_0$. It is desirable that the interval is as short as possible, however, if it is too short, the discharge limit is determined by this. Therefore, the shortest interval by which the discharge does not occur is desirable. The opposing faces of the electrode and the separating plate are considered to be almost parallel plates even though they depend on the processing of the angle of the electrodes. Therefore, when the interval is selected in such a way that it is nearly equal to or slightly larger than the interval between the adjacent electrodes where they are closest as mentioned above, the interval is effective because it has a slightly large margin.

This embodiment 17 corresponds to the thirteenth aspect of the present invention.

Embodiment 18.

In the above-described embodiment 17, an explanation was given for the case of the split coaxial RFQ linac, however, in the 4 vane type RFQ linac, it is sufficient to make the interval between the separating plate and the electrode to be nearly equal to or slightly larger than the interval between the adjacent electrodes where they are closest. Namely, in the 4 vane type RFQ linac, the four electrodes (the top portions of the vanes) are separated from the separating plate, the separating plate is the earth potential, and the four electrodes has potential difference of $+V_0/2$ and $-V_0/2$ with respect to the separating plate. Accordingly, different from the split coaxial RFQ linac shown in the embodiment 17, when the interval between the separating plate and the electrode is selected in such a way that it is nearly equal to or slightly larger than the half of the interval between the adjacent electrodes where they are closest as mentioned above, the interval is effective because it has a slightly large margin. By this arrangement, in the 4 vane type RFQ linac also, an apparatus without the problem of the discharge limit and with a small beam loss can be realized.

This embodiment 18 corresponds to the fourteenth aspect of the present invention.

From the foregoing description, it will be apparent that, according to the first aspect of the present invention, by splitting an accelerating cavity in a high frequency sense into two by a plane perpendicular to a beam axis direction, and by making the radio frequency power level in the downstream accelerating cavity to be lower than the radio frequency power level in the upstream accelerating cavity, beams with various energies can be efficiently emitted from the accelerating cavity without lowering the power efficiency.

According to the second aspect of the present invention, by, the ratio between the lengths of the upstream accelerating cavity and the downstream accelerating cavity in the beam direction is one to one, thereby the radio frequency power losses in the two accelerating cavities can be made to be nearly equal so that the two high frequency power amplifiers can be fabricated by the same specification.

According to the third aspect of the present invention, by making the synchronizing phase in the downstream accelerating cavity is made to be constant by the electrodes, the radio frequency power levels at which the separatrics are disappeared can be made to be nearly equal for all cells in the downstream accelerating cavity, resulting in an effect in that the energy spread of the emitted beams can be made small so that the electrode parameters can be easily determined.

According to the fourth aspect of the present invention, the first radio frequency system is a self excited system, and the second radio frequency system is a separately excited system operated by a frequency determined by a resonant frequency in the upstream accelerating cavity, thereby, even when the resonant frequency in the separately excited system is changed due to the change of temperature and so forth, the frequency generated by a signal generating unit is changed depending on the change of the resonant frequency, so that only one of the two divided accelerating cavities may have a frequency tuner system for keeping the resonant frequency of the accelerating cavity to be equal to the output frequency of the signal generating unit, resulting in the effects of reducing the cost and improving the reliability of the apparatus.

According to the fifth aspect of the present invention, by cutting and separating the electrodes in the accelerating cavity by a plane substantially perpendicular to the beam direction, and by providing a separating plate of conductor between the cut and separated electrodes, the power loss in the accelerating cavity can be minimized by the separating plate.

According to the sixth aspect of the present invention, by providing, in the separating plate defined, holes through which the radio frequency power cannot be passed, the separated cavities can be deemed as a single cavity in a sense of vacuum so that only one set of exhaust unit may be provided. Further, by making the holes to be long holes arranged radially on the separating plate, the power loss in the separating plate can be reduced.

According to the seventh aspect of the present invention, by providing a vacuum duct branched to be connected to the upstream accelerating cavity and the downstream accelerating cavity, it is not necessary to provide a hole for vacuum exhaust in the separating plate so that the power loss in the separating plate can be reduced.

According to the eighth aspect of the present invention, by making the length between the cut and separated electrodes to be even times as much as the length of one cell, the beam can be inputted into the downstream accerelating cavity with the phase of the beam emitted from the upstream accerelating cavity, so that the adjustment between the radio frequency phases of the two accelerating cavities is not necessary.

According to the ninth aspect of the present invention, by providing phase adjusting means, the phase of the radio frequency power in the upstream accelerating cavity and the phase of the radio frequency power in the down stream accelerating cavity can be relatively changed so that the distance between the out and separated electrodes can be selected arbitrarily, resulting in that the beam loss at the position where the electrodes are cut and separated can be minimized.

According to the tenth aspect of the present invention, by making the size of the beam passing window of the separating plate to be substantially equal to the size of the minimum beam aperture of cells as mentioned above, the relation between the independence of the two accerelating cavities in the radio frequency sense and the beam loss at the position where the electrodes are cut and separated can be optimized.

According to the eleventh aspect of the present invention, by making the position at which the electrodes are cut and separated to be the position of one of the tops or the bottoms, the leakage electric field at the position where the electrodes are cut and separated can be minimized so that the influence of the leakage electric field on the beam can be minimized.

According to the twelfth aspect of the present invention, by making the thickness of the separating plate to be thin in the periphery of the beam passing window, the distance between the out and separated electrodes can be minimized without deteriorating the mechanical strength of the separating plate.

According to the thirteenth aspect of the present invention, by making the distance between the separating plate and each of the electrodes to be equal to or larger than the minimum distance between adjacent electrodes, the beam loss is reduced.

According to the fourteenth aspect of the present invention, in a 4 vane type RFQ linac, by making the distance between the separating plate and each of the electrodes is equal to or larger than half of the minimum distance between adjacent electrodes, the beam loss can be reduced without a problem of a discharge limit.

What is claimed is:

1. A variable energy radio frequency quadrupole linac, comprising:

an accelerating cavity having a longitudinal axis disposed along a length of the accelerating cavity;

a plurality of electrodes disposed within the accelerating cavity in a direction parallel to the longitudinal axis therefrom for focusing and accelerating charged particles by a radio frequency quadrupole electric field generated between said electrodes; and means for dividing the accelerating cavity, in a radio frequency sense, into an upstream accelerating cavity and a downstream accelerating cavity permitting a radio frequency power level in said downstream accelerating cavity to be lower in comparison with a radio frequency power level in said upstream accelerating cavity.

2. A variable energy radio frequency quadrupole linac as claimed in claim 1, wherein a ratio between a length of said upstream accelerating cavity and a length of said downstream accelerating cavity along the longitudinal axis of the accelerating cavity is one to one.

3. A variable energy radio frequency quadrupole linac as claimed in claim 1, wherein the downstream accelerating cavity includes a plurality of cells, each cell having a length that enables a phase of the radio frequency power level in the downstream accelerating cavity to advance by $\pi$ so that a synchronizing phase in said downstream accelerating cavity is constant.

4. A variable energy radio frequency quadrupole linac as claimed in claim 1 further comprising a first radio frequency system for supplying a radio frequency power to said upstream accelerating cavity, and a second radio frequency system for supplying radio frequency power to said down stream accelerating cavity, said first radio frequency system being a self excited system, and said second radio frequency system being a separately excited system operated by a frequency determined by a resonant frequency in said upstream accelerating cavity.

5. A variable energy radio frequency quadrupole linac, comprising:

an accelerating cavity having a longitudinal axis disposed along a length of the accelerating cavity;

a plurality of electrodes disposed within the accelerating cavity in a direction parallel to the longitudinal axis for focusing and accelerating charged particles by a radio frequency quadruple electric field generated between said electrodes; and means for dividing the accelerating cavity, in a radio frequency sense, into an upstream accelerating cavity and a downstream accelerating cavity permitting a radio frequency power level in said downstream accelerating cavity to be lower in comparison with a radio frequency power level in said upstream accelerating cavity, wherein said electrodes in said accelerating cavity are cut and separated by the means for dividing, the means for dividing including a separating plate provided between said cut and separated electrodes, said separating plate being made of a conductor having a beam passing window, and covering a cross section of said accelerating cavity.

6. A variable energy radio frequency quadrupole linac as claimed in claim 5, wherein said separating plate is provided with holes, each of said holes having a so small size that the radio frequency power cannot be passed through said holes.

7. A variable energy radio frequency quadrupole linac as claimed in claim 5 further comprising a vacuum exhaust duct, said upstream accelerating cavity and said down accelerating cavity having exhaust ports respectively, said vacuum exhaust duct being branched to be connected to said exhaust ports.

8. A variable energy radio frequency quadrupole linac as claimed in claim 5, wherein the downstream accelerating cavity includes a plurality of cells, each cell having a length that enables a phase of the radio frequency power level in the downstream accelerating cavity to advance by $\pi$, a length between said cut and separated electrodes being even times as much as the length of each cell in said downstream accelerating cavity.

9. A variable energy radio frequency quadrupole linac as claimed in claim 5 further comprising phase adjusting means for relatively changing the phase of the radio frequency power in said upstream accelerating cavity and the phase of the radio frequency power in said down stream accelerating cavity.

10. A variable energy radio frequency quadrupole linac as claimed in claim 5, wherein said separating plate is provided with a beam passing window having a size substantially equal to a size of a minimum beam aperture of cells before and after a separating position at which said electrodes are cut and separated.

11. A variable energy radio frequency quadrupole linac as claimed in claim 5, wherein said electrodes are waving electrodes having tops and bottoms, the position at which said electrodes are cut and separated being the position of one of said tops or said bottoms.

12. A variable energy radio frequency quadrupole linac as claimed in claim 5, wherein in the periphery of said beam passing window of said separating plate, a thin plate region in which the thickness of said separating plate is made to be thin is formed.

13. A variable energy radio frequency quadrupole linac as claimed in claim 5, wherein the distance between said separating plate and each of said electrodes is equal to or larger than the minimum distance between adjacent electrodes.

14. A variable energy radio frequency quadrupole linac as claimed in claim 5, wherein said variable energy radio frequency quadrupole linac is a 4 vane type RFQ linac, the distance between said separating plate and each of said electrodes is equal to or larger than half of the minimum distance between adjacent electrodes.

15. A variable energy frequency quadrupole linac, comprising:

an accelerating cavity having an upstream cavity and a downstream cavity;

means for accelerating particles through the accelerating cavity in response to radio frequency power being applied to the accelerating cavity; and a radio frequency separator that separates first radio frequency power applied to the upstream cavity and second radio frequency power applied to the downstream cavity permitting a radio frequency power level in the downstream cavity to be lower than a radio frequency power level in the upstream cavity.

16. A variable energy radio frequency quadrupole linac as claimed in claim 15, wherein a ratio between a length of the upstream cavity and a length of the downstream cavity is one to one.

17. A variable energy radio frequency quadrupole linac as claimed in claim 15, wherein the means for accelerating particles includes means for providing a constant synchronizing phase to the downstream cavity.

18. A variable energy radio frequency quadrupole linac as claimed in claim 15, further comprising a first radio frequency system coupled to the upstream cavity, the first radio frequency system generating a first radio signal in the upstream cavity according to feedback received from the upstream cavity; and a second radio frequency system coupled to the upstream cavity and the downstream cavity, the second radio frequency system generating a second radio signal in the downstream cavity according to the feedback received from the upstream cavity.

19. A variable energy radio frequency quadrupole linac as claimed in claim 15, wherein the radio frequency separator includes a separating plate covering a cross section of the accelerating cavity, thereby separating the upstream cavity and the downstream cavity, in a radio frequency sense.

20. A variable energy radio frequency quadrupole linac as claimed in claim 19, wherein the separating plate has a plurality of holes, each hole having a diameter that prevents radio frequency power from passing through the hole.

21. A variable energy radio frequency quadrupole linac as claimed in claim 19, wherein both the upstream cavity and the downstream cavity each have an exhaust port, and the linac further comprises a vacuum exhaust duct coupled to the exhaust port of the upstream cavity and the exhaust port of the downstream cavity.

22. A variable energy radio frequency quadrupole linac as claimed in claim 19, wherein the means for accelerating particles includes a first plurality of electrodes disposed within the upstream cavity and a second plurality of electrodes disposed within the downstream cavity, the first plurality of electrodes being separated from the second plurality of electrodes by an even number of lengths of one cell of the accelerating cavity, the length of one cell equaling a distance through which a phase of the radio frequency power is changed by $\pi$.

23. A variable energy radio frequency quadrupole linac as claimed in claim 19, further comprising means for adjusting a phase of the radio frequency power in the upstream cavity and a phase of the radio frequency power in the downstream cavity.

24. A variable energy radio frequency quadrupole linac as claimed in claim 19, wherein the separating plate includes a beam passing window having a size substantially equal to a size of a minimum beam aperture of cells.

25. A variable energy radio frequency quadrupole linac as claimed in claim 19, wherein the means for accelerating particles includes a plurality of waving electrodes, each electrode having tops and bottoms, a position at which the plurality of electrodes are separated being the position of one of the tops or the bottoms.

26. A variable energy radio frequency quadrupole linac as claimed in claim 19, wherein the separating plate includes a thin plate region defining a beam passing window.

27. A variable energy radio frequency quadrupole linac as claimed in claim 19, wherein the means for accelerating particles includes a plurality of electrodes disposed within the accelerating cavity, wherein each distance between the separating plate and an electrode is equal or greater than a minimum distance between adjacent electrodes.

28. A variable energy radio frequency quadrupole linac as claimed in claim 19, the linac being a 4 vane type RFQ linac, wherein the means for accelerating particles includes a plurality of electrodes, and a distance between the separating plate and each electrode is equal to or greater than half of a minimum distance between adjacent electrodes.

29. A variable energy radio frequency quadrupole linac as claimed in claim 15, wherein the radio frequency separator is disposed between the upstream cavity and the downstream cavity.

30. A variable energy radio frequency quadrupole linac as claimed in claim 15, further including means for applying first radio frequency power to the upstream cavity; and means for applying second radio frequency power to the downstream cavity.

31. A variable energy radio frequency quadrupole linac as claimed in claim 30, wherein the first radio frequency power is greater than the second radio frequency power.

32. A variable energy radio frequency quadrupole linac as claimed in claim 15, wherein the accelerating cavity has a disk-shaped cross-section; and the radio frequency separator includes a separating plate having a disk-shaped form to cover the cross-section of the accelerating cavity.

33. A variable radio frequency quadrupole linac as claimed in claim 32, wherein the separating plate includes a beam passing window; and a surface extending from the beam passing window to an outer edge of separating plate to weaken a magnetic coupling between the upstream cavity and the downstream cavity.

34. A variable radio frequency quadrupole linac as claimed in claim 33, wherein the means for accelerating particles includes electrodes disposed in a parallel direction to a longitudinal axis of the accelerating cavity.

35. A variable radio frequency quadrupole linac as claimed in claim 34, wherein the electrodes are one of waving electrodes, angular type electrodes, four-rod electrodes, four-vane type electrodes, and double-H type electrodes.

36. A variable energy radio frequency quadrupole linac as claimed in claim 33, wherein the separating plate further includes a thin plate portion that defines both the beam passing window and a portion of the surface of the separating plate.

37. A variable energy radio frequency quadrupole linac as claimed in claim 33, wherein the beam passing window is disposed in a central area of the separating plate.

38. A variable energy radio frequency quadrupole linac as claimed in claim 33, wherein the beam passing window is disposed in an off-center location of the separating plate.

39. A variable energy radio frequency quadrupole linac as claimed in claim 33, wherein the surface of the separating plate defines a plurality of elongated holes extending from the beam passing window towards the outer edge of the separating plate, permitting exhaust to travel between the upstream cavity and the downstream cavity.

40. A variable energy radio frequency quadrupole linac as claimed in claim 37, further including supporters that fix the electrodes to the separating plate.

41. A variable energy frequency quadrupole linac, comprising:

an accelerating cavity having an upstream cavity and a downstream cavity;

electrodes that accelerate particles through the accelerating cavity in response to radio frequency power being applied to the accelerating cavity, the electrodes being disposed along a longitudinal axis of the accelerating cavity, and being cut and separated by a plane substantially perpendicular to a beam direction of the particles; and a separating plate provided between the cut and separated electrodes, the separating plate being made of a conductor having a beam passing window, and covering a cross-section of the accelerating cavity thereby permitting a radio frequency power level in the downstream accelerating cavity to be lower in comparison with a radio frequency power level in the upstream accelerating cavity.

* * * * *